US010912708B2

(12) United States Patent
Marton et al.

(10) Patent No.: US 10,912,708 B2
(45) **Date of Patent: *Feb. 9, 2021**

(54) BATTERY-POWERED PERCUSSIVE MASSAGE DEVICE

(71) Applicant: Hyper Ice, Inc., Irvine, CA (US)

(72) Inventors: Robert Marton, Yorba Linda, CA (US); Anthony Katz, Laguna Niguel, CA (US)

(73) Assignee: Hyper Ice, Inc., Irvine, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/931,860

(22) Filed: Jul. 17, 2020

(65) Prior Publication Data

US 2020/0352823 A1 Nov. 12, 2020

Related U.S. Application Data

(63) Continuation of application No. 15/902,542, filed on Feb. 22, 2018.

(51) Int. Cl.
*A61H 23/00* (2006.01)
*A61H 23/02* (2006.01)

(52) U.S. Cl.
CPC ..... *A61H 23/006* (2013.01); *A61H 23/0254* (2013.01); *A61H 2201/0153* (2013.01);
(Continued)

(58) Field of Classification Search
CPC .. A61H 23/006; A61H 23/0254; A61H 23/06; A61H 2201/1669;
(Continued)

(56) References Cited

U.S. PATENT DOCUMENTS 4,088,128 A 5/1978 Mabuchi
4,513,737 A 4/1985 Mabuchi
(Continued)

FOREIGN PATENT DOCUMENTS

CN 2144503 Y 10/1993
CN 2540948 Y 3/2003
(Continued)

*Primary Examiner* — Colin W Stuart
*Assistant Examiner* — Douglas Y Sul
(74) *Attorney, Agent, or Firm* — Patterson Intellectual Property Law, P.C.; Jerry Turner Sewell

(57) ABSTRACT

A percussive massage device includes an enclosure having a cylindrical bore that extends along a longitudinal axis. A motor has a rotatable shaft that rotates about a central axis perpendicular to the longitudinal axis. A crank coupled to the shaft includes a pivot, which is offset from the central axis of the shaft. A transfer bracket has a first end portion coupled to the pivot of the crank. A flexible transfer linkage has a first end coupled to a second end portion of the transfer bracket. A piston has a first end coupled to a second end of the transfer linkage. The piston is constrained to move within a cylinder along the longitudinal axis of the cylindrical bore. An applicator head has a first end coupled to a second end of the piston and has a second end exposed outside the cylindrical bore for application to a person receiving treatment.

18 Claims, 21 Drawing Sheets

(52) U.S. Cl.
CPC ..... *A61H 2201/0157* (2013.01); *A61H 2201/1215* (2013.01); *A61H 2201/149* (2013.01); *A61H 2201/1436* (2013.01); *A61H 2201/1669* (2013.01)

(58) Field of Classification Search
CPC ..... A61H 2201/0153; A61H 2201/149; A61H 2201/1215; A61H 2201/1436; A61H 2201/0157; A61H 2201/5043; A61H 2201/5046
USPC ..... 173/217; 320/DIG. 18–DIG. 21
See application file for complete search history.

(56) References Cited

U.S. PATENT DOCUMENTS

| | | | | |
|---|---|---|---|---|
| 4,549,535 | A | 10/1985 | Wing | |
| 4,726,430 | A | 2/1988 | Hendrikx et al. | |
| 4,790,296 | A | 12/1988 | Segal | |
| 4,841,955 | A | 6/1989 | Evans et al. | |
| 5,656,017 | A | 8/1997 | Keller et al. | |
| 5,733,029 | A | 3/1998 | Monroe | |
| 5,769,657 | A | 6/1998 | Kondo et al. | |
| 6,228,042 | B1 | 5/2001 | Dungan | |
| 6,682,496 | B1 * | 1/2004 | Pivaroff | A61H 7/005 601/101 |
| 8,826,547 | B2 | 9/2014 | Oberheim | |
| 8,841,871 | B2 * | 9/2014 | Yang | G01R 31/3646 318/400.08 |
| 9,364,626 | B2 * | 6/2016 | Carter | H01M 10/488 |
| 9,889,066 | B2 | 2/2018 | Danby et al. | |
| 10,314,762 | B1 | 6/2019 | Marton et al. | |
| 10,456,325 | B2 | 10/2019 | Fan | |
| 10,492,984 | B2 * | 12/2019 | Marton | A61H 23/0254 |
| 10,561,574 | B1 * | 2/2020 | Marton | A61H 23/0263 |
| 2004/0254507 | A1 | 12/2004 | Off | |
| 2006/0211961 | A1 | 9/2006 | Meyer et al. | |
| 2006/0293711 | A1 | 12/2006 | Keller et al. | |
| 2008/0262399 | A1 | 10/2008 | Kovelman et al. | |
| 2009/0270915 | A1 | 10/2009 | Tsai et al. | |
| 2010/0164434 | A1 * | 7/2010 | Cacioppo | G06F 3/03545 320/115 |
| 2010/0274162 | A1 | 10/2010 | Evans | |
| 2011/0017742 | A1 | 1/2011 | Sausen et al. | |
| 2012/0038483 | A1 * | 2/2012 | Du | G08B 5/36 340/636.1 |
| 2012/0215141 | A1 | 8/2012 | Peddicord | |
| 2012/0281392 | A1 * | 11/2012 | Workman | H02J 7/35 362/183 |
| 2012/0296244 | A1 | 11/2012 | Ceoldo et al. | |
| 2013/0261516 | A1 | 10/2013 | Cilea | |
| 2013/0281897 | A1 | 10/2013 | Hoffmann et al. | |
| 2014/0031866 | A1 * | 1/2014 | Fuhr | A61H 1/008 606/239 |
| 2015/0005682 | A1 * | 1/2015 | Danby | A61H 23/0254 601/101 |
| 2015/0107383 | A1 | 4/2015 | Duesselberg et al. | |
| 2015/0182415 | A1 | 7/2015 | Olkowski et al. | |
| 2016/0151238 | A1 * | 6/2016 | Crunick | A61H 23/0263 601/2 |
| 2016/0278436 | A1 * | 9/2016 | Verleur | A24F 47/008 |
| 2016/0354277 | A1 | 12/2016 | Fima | |
| 2016/0367425 | A1 | 12/2016 | Wersland | |
| 2017/0027798 | A1 | 2/2017 | Wersland | |
| 2017/0087379 | A1 | 3/2017 | Sedic | |
| 2017/0333280 | A1 | 11/2017 | Black | |
| 2018/0008512 | A1 * | 1/2018 | Goldstein | A61N 2/002 |
| 2018/0168913 | A1 | 6/2018 | Sedic | |
| 2018/0200141 | A1 | 7/2018 | Wersland et al. | |
| 2020/0093945 | A1 * | 3/2020 | Jeong | A61L 2/26 |

FOREIGN PATENT DOCUMENTS

| | | | |
|---|---|---|---|
| CN | 2694966 | Y | 4/2005 |
| CN | 101801326 | A | 8/2010 |
| CN | 202459196 | U | 10/2012 |
| CN | 202536467 | U | 11/2012 |
| CN | 103655142 | A | 3/2014 |
| CN | 205017429 | U | 2/2016 |
| CN | 205268525 | U | 6/2016 |
| CN | 206381389 | U | 8/2017 |
| KR | 200311328 | Y1 | 5/2003 |
| TW | M543692 | U | 6/2017 |
| WO | 2009014727 | A1 | 1/2009 |

* cited by examiner

BATTERY-POWERED PERCUSSIVE MASSAGE DEVICE

RELATED APPLICATIONS

This application is a continuation of U.S. patent application Ser. No. 15/902,542, filed on Feb. 22, 2018, for "Battery-Powered Percussive Massage Device," which is incorporated herein in its entirety.

FIELD OF THE INVENTION

The present invention is in the field of therapeutic devices, and, more particularly, is in the field of devices that apply percussive massage to selected portions of a body.

BACKGROUND OF THE INVENTION

Percussive massage, which is also referred to as tapotement, is the rapid, percussive tapping, slapping and cupping of an area of the human body. Percussive massage is used to more aggressively work and strengthen deep-tissue muscles. Percussive massage increases local blood circulation and can even help tone muscle areas. Percussive massage may be applied by a skilled massage therapist using rapid hand movements; however, the manual force applied to the body varies, and the massage therapist may tire before completing a sufficient treatment regime.

Percussive massage may also be applied by electromechanical percussive massage devices (percussive applicators), which are commercially available. Such percussive applicators may include, for example, an electric motor coupled to drive a reciprocating piston within a cylinder. A variety of percussive heads may be attached to the piston to provide different percussive effects on selected areas of the body. Many of the known percussive applicators are expensive, large, relatively heavy, and tethered to an electrical power source. For example, some percussive applicators may require users to grip the applicators with both hands in order to control the applicators. Some percussive applicators are relatively noisy because of the conventional mechanisms used to convert the rotational energy of an electric motor to the reciprocating motion of the piston.

SUMMARY OF THE INVENTION

A need exists for an electromechanical percussive massage device that is less costly, is small, has a relatively light weight, and is portable (e.g., untethered to an electrical power source). A further need exists for an electromechanical percussive massage device that is quitter (less noisy) than conventional devices.

One aspect of the embodiments disclosed herein is a percussive massage device that includes an enclosure having a cylindrical bore that extends along a longitudinal axis. A motor has a rotatable shaft that rotates about a central axis perpendicular to the longitudinal axis. A crank coupled to the shaft includes a pivot, which is offset from the central axis of the shaft. A transfer bracket has a first end portion coupled to the pivot of the crank. A flexible transfer linkage has a first end coupled to a second end portion of the transfer bracket. A piston has a first end coupled to a second end of the transfer linkage. The piston is constrained to move within a cylinder along the longitudinal axis of the cylindrical bore. An applicator head has a first end coupled to a second end of the piston and has a second end exposed outside the cylindrical bore for application to a person receiving treatment.

Another aspect of the embodiments disclosed herein is a percussive massage device. The device comprises an enclosure having a cylindrical bore. The cylindrical bore extends along a longitudinal axis. A motor is positioned within the enclosure. The motor has a rotatable shaft having a central axis. The central axis of the shaft is perpendicular to the longitudinal axis of the cylindrical bore. A crank is coupled to the shaft. The crank includes a pivot, which is offset from the central axis of the shaft. A transfer bracket has a first end portion coupled to the pivot of the crank. A flexible transfer linkage has a first end coupled to a second end portion of the transfer bracket. A piston has a first end coupled to a second end of the transfer linkage. The piston is positioned within the cylindrical bore of the enclosure and is constrained to move only along the longitudinal axis of the cylindrical bore. An applicator head has a first end coupled to a second end of the piston. A second end of the applicator head is exposed outside the cylindrical bore. In certain embodiments in accordance with this aspect, the pivot of the crank is rotatable 360 degrees about the central axis of the shaft of the motor. The pivot is substantially aligned with the longitudinal axis of the cylindrical bore at a first rotational position and at a second rotational position. The first and second rotational positions are spaced apart angularly by 180 degrees. The pivot is offset from the longitudinal axis in a first offset direction when the pivot is at a rotational position between the first rotational position and the second rotational position in a first angular direction with respect to the first rotational position. The pivot is offset from the longitudinal axis in a second offset direction when the pivot is at a rotational position between the first rotational position and the second rotational position in a second angular direction opposite the first angular direction. The flexible transfer linkage is substantially straight and is aligned with the longitudinal axis of the cylindrical bore when the pivot of the crank is aligned with the longitudinal axis of the central bore at the first rotational position or at the second rotational position. The flexible transfer linkage bends in a first direction with respect to the longitudinal axis of the cylindrical bore when the pivot of the crank is offset from the longitudinal axis in the first offset direction. The flexible transfer linkage bends in a second direction with respect to the longitudinal axis of the cylindrical bore when the pivot of the crank is offset from the longitudinal axis in the second offset direction. In certain embodiments, the applicator head is removably coupled to the piston. In certain embodiments, the flexible transfer linkage comprises resilient rubber. In certain embodiments, the resilient rubber has a Shore durometer hardness of approximately 50.

Another aspect of the embodiments disclosed herein is a method of operating a percussive massage device. The method comprises rotating a shaft of an electric motor to rotate a pivot of a crank about a centerline of the shaft; coupling the pivot of the crank to a first end of a flexible interconnection linkage of a reciprocation assembly; coupling a second end of the flexible interconnection linkage to a piston constrained to move along a longitudinal centerline; and coupling the piston to an applicator head wherein rotational movement of the pivot of the crank causes reciprocation longitudinal movement of the piston and the applicator head. In certain embodiments of the method, the applicator head is removably coupled to the piston. In certain embodiments of the method, the flexible transfer linkage comprises resilient rubber. In certain embodiments of the method, the resilient rubber has a Shore durometer hardness of approximately 50.

Another aspect of the embodiments disclosed herein is a method of assembling a percussive massage device. The method comprises attaching an eccentric crank to the shaft of a motor, the eccentric crank having a pivot; coupling a first portion of a bearing holder to the pivot of the eccentric crank; attaching a first end of a flexible interconnection linkage to a second portion of the bearing holder; attaching a second end of the flexible interconnection linkage to a first end of a piston, the piston constrained to longitudinal movement within a cylinder; and removably attaching an applicator head to a second end of the piston. In certain embodiments of the method, the flexible transfer linkage comprises resilient rubber. In certain embodiments of the method, the resilient rubber has a Shore durometer hardness of approximately 50.

BRIEF DESCRIPTIONS OF THE DRAWINGS

The foregoing aspects and other aspects of the disclosure are described in detail below in connection with the accompanying drawings in which.

Figure 1:
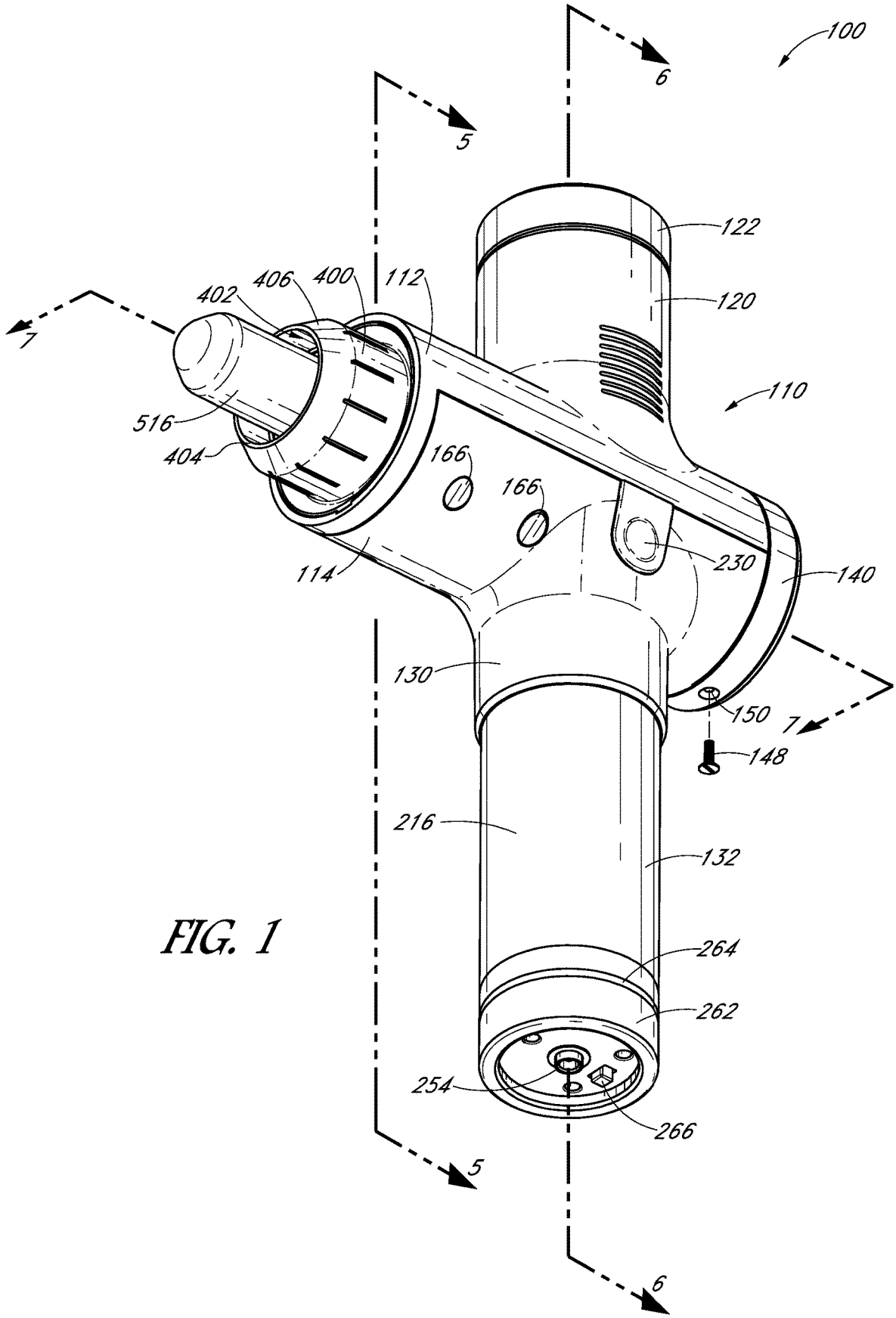
FIG. 1 illustrates a bottom perspective view of a portable electromechanical percussive massage applicator that is battery powered and has a single hand grip, the view in FIG. 1 showing the bottom, the left side and the distal end (the end facing away from a user (not shown)) of the applicator.
Figure 2:
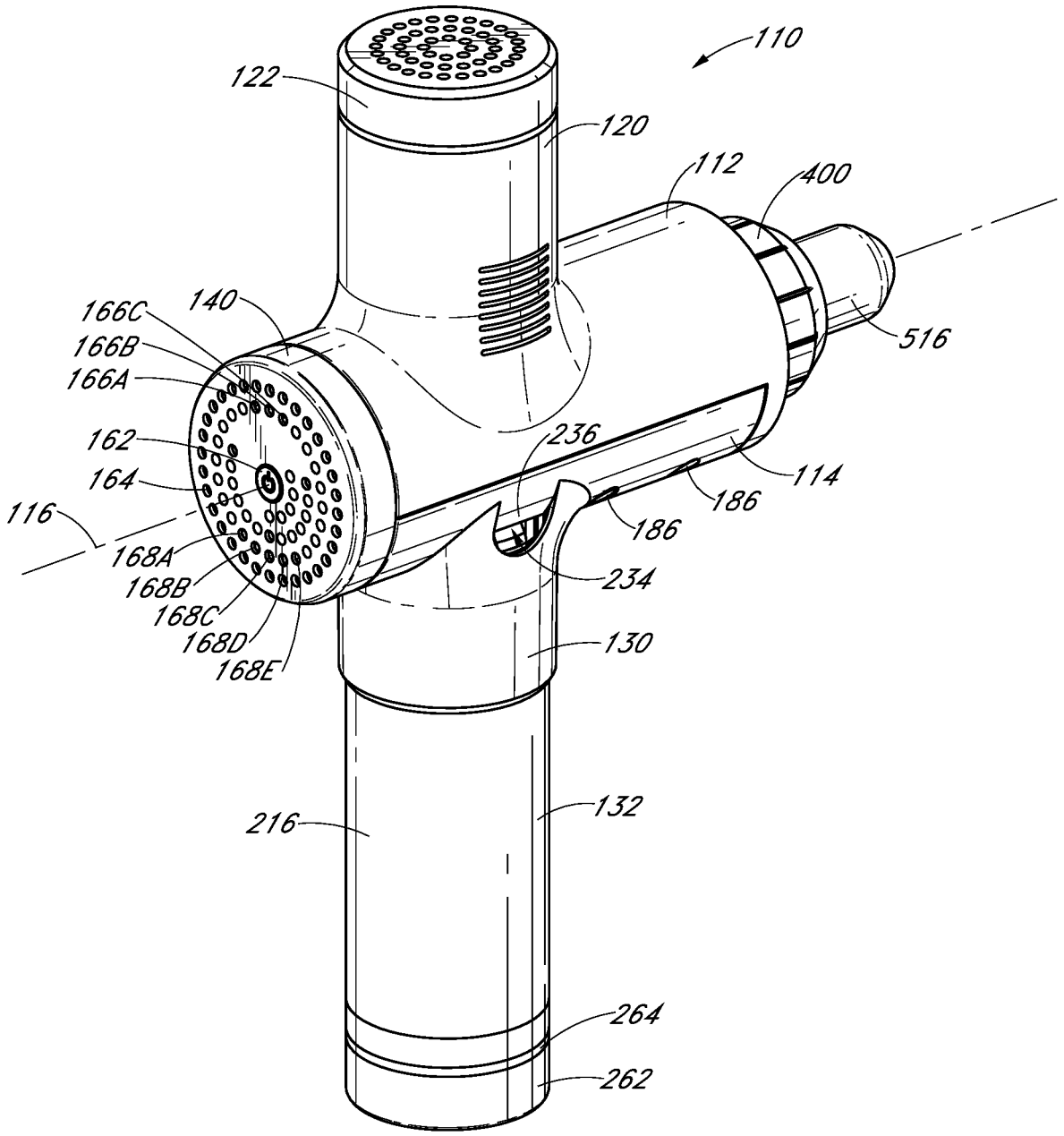
FIG. 2 illustrates a top perspective view of the portable electromechanical percussive massage applicator of FIG. 1 showing the top, the right side and the proximal end (the end closest to a user (not shown)) of the applicator.
Figure 17:
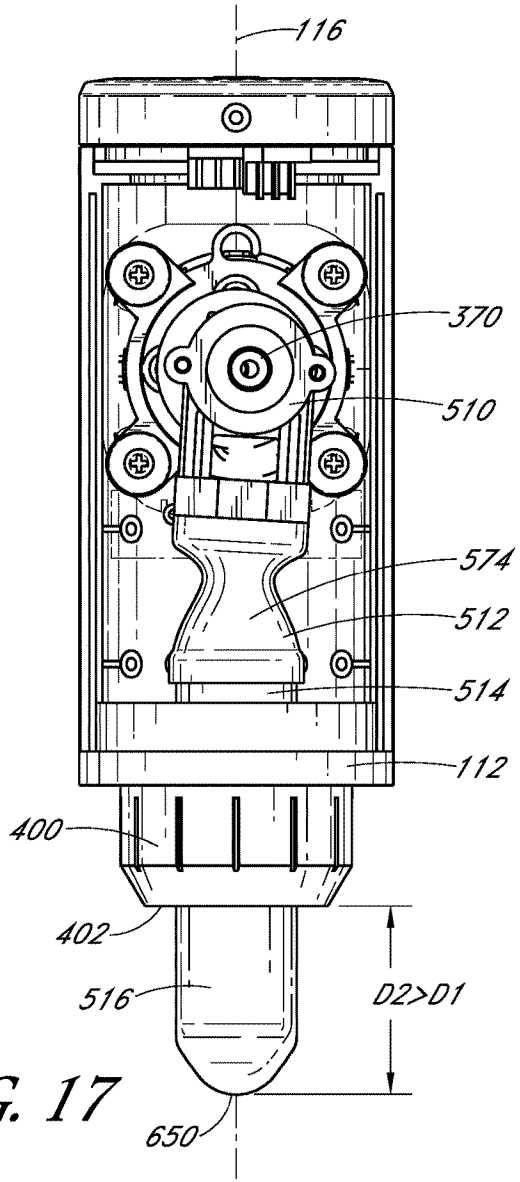
FIG. 17 illustrates a plan view of the portable electromechanical percussive massage applicator similar to the view of FIG. 16, the view in FIG. 17 showing the crank in the 3 o'clock position (as viewed in FIG. 17) such the applicator head is extended a second distance from the housing of the applicator, wherein the second distance is greater than the first distance of FIG. 16.
Figure 16:
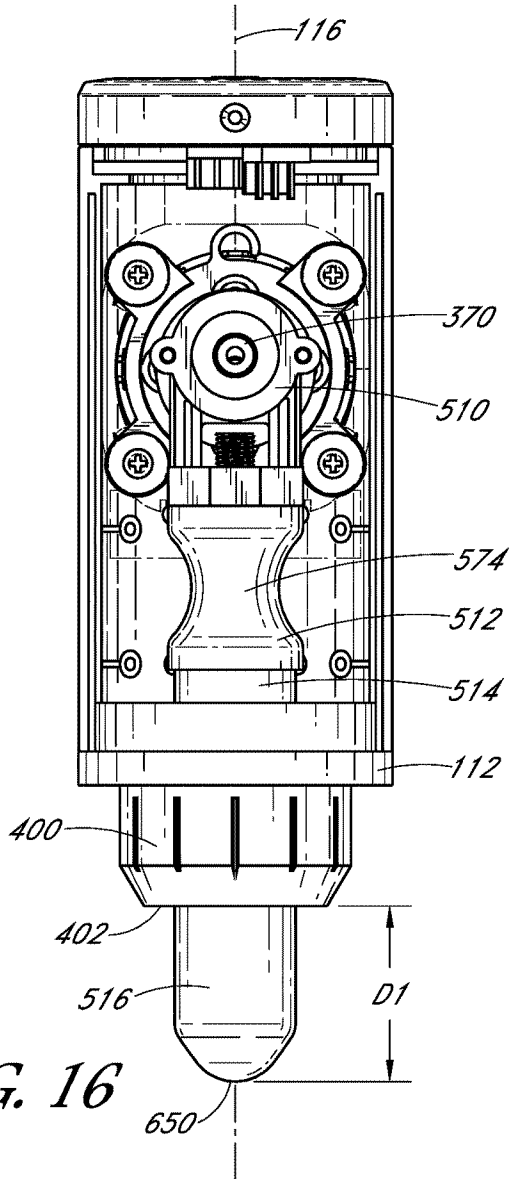
FIG. 16 illustrates a plan view of the percussive massage applicator of FIGS. 1 and 2 with the lower cover removed, the view looking upward toward the electrical motor of the applicator, the view in FIG. 16 showing the crank in the 12 o'clock position (as viewed in FIG. 16) such the end of the applicator head is extended a first distance from the housing of the applicator.
Figure 19:
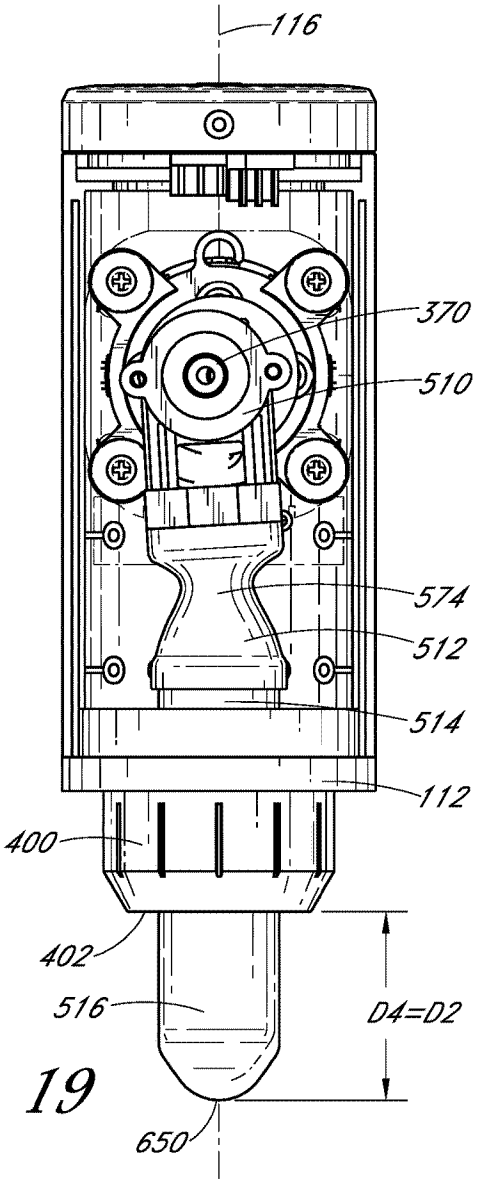
Figure 18:
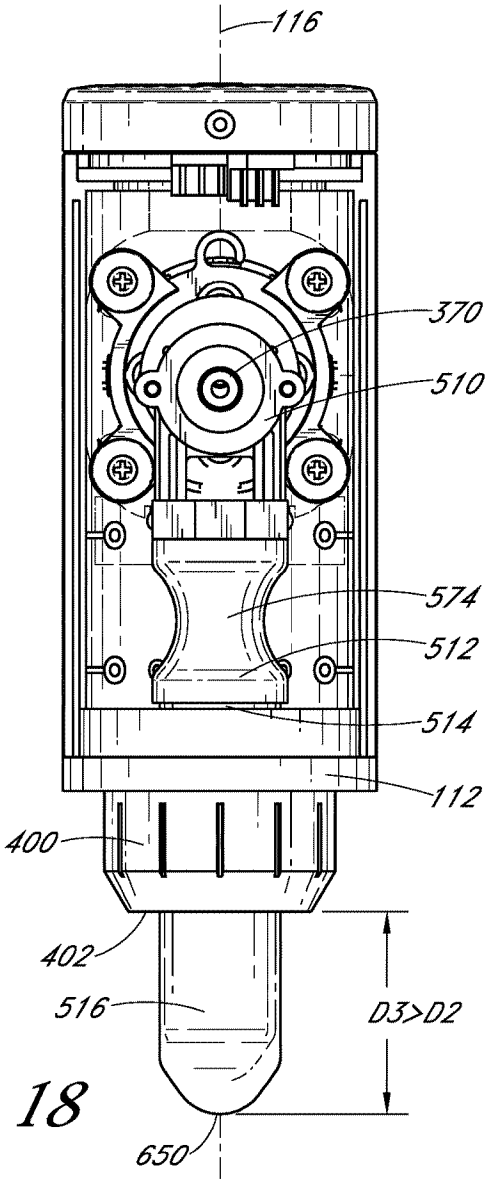
FIG. 18 illustrates a plan view of the portable electromechanical percussive massage applicator similar to the views of FIGS. 16 and 17, the view in FIG. 18 showing the crank in the 6 o'clock position (as viewed in FIG. 18) such the applicator head is extended a third distance from the housing of the applicator, wherein the third distance is greater than the second distance of FIG. 17.
Figure 20:
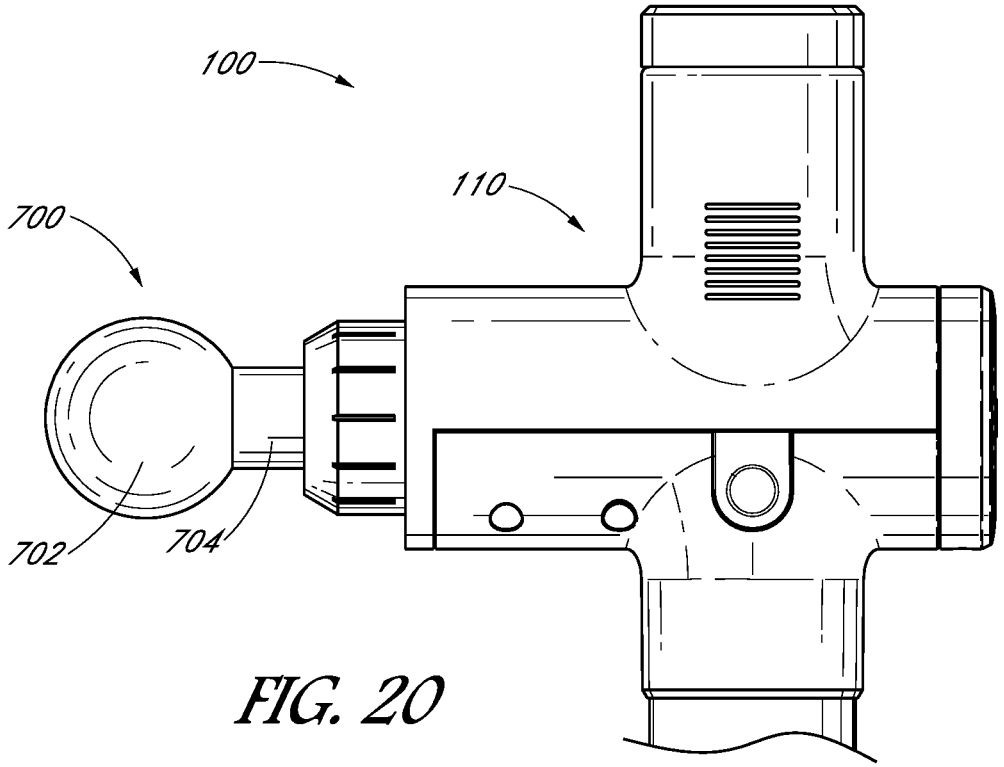
Figure 21:
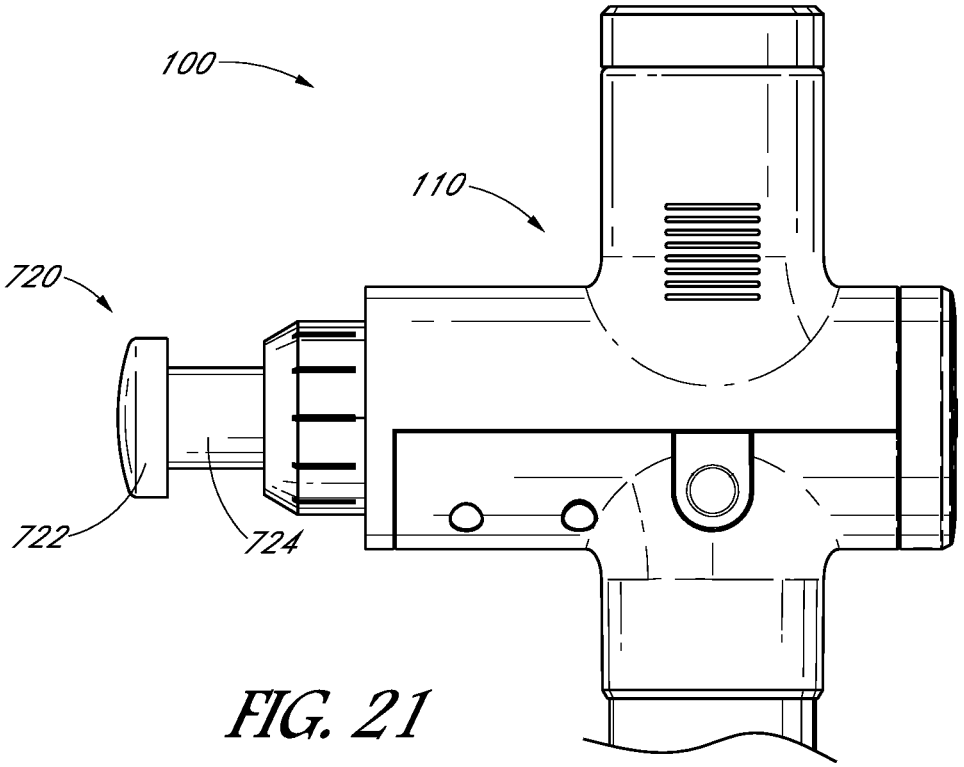
Figure 22:
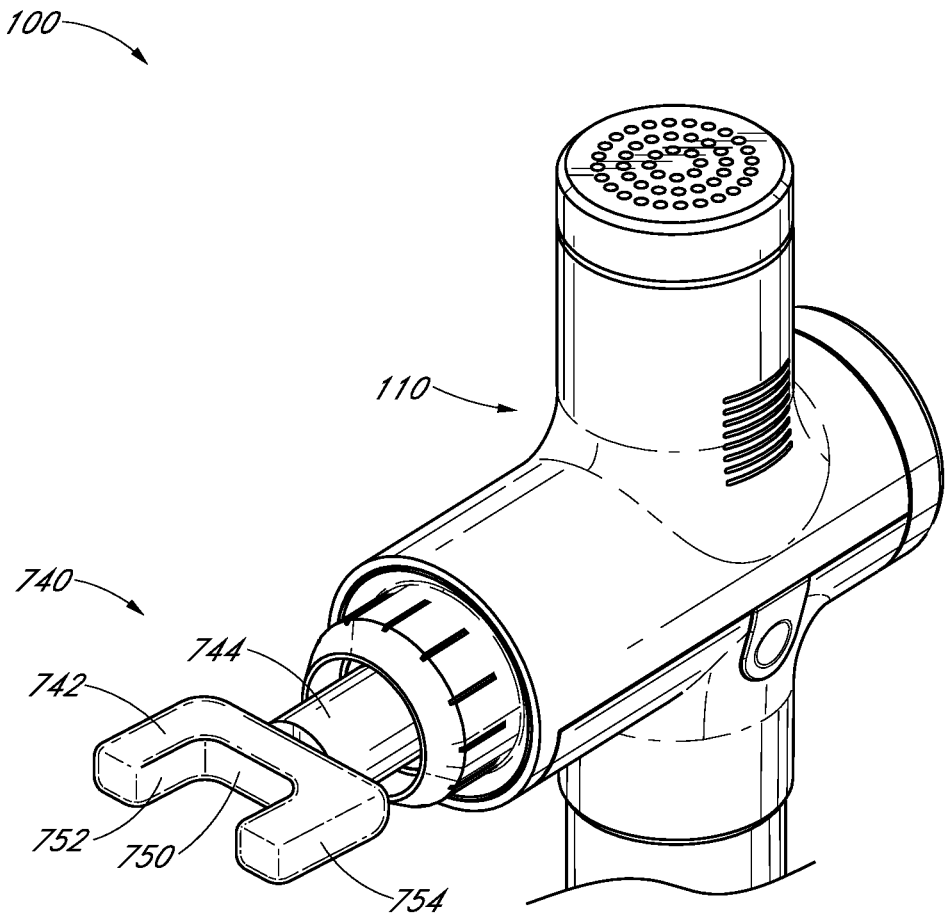
Figure 23:
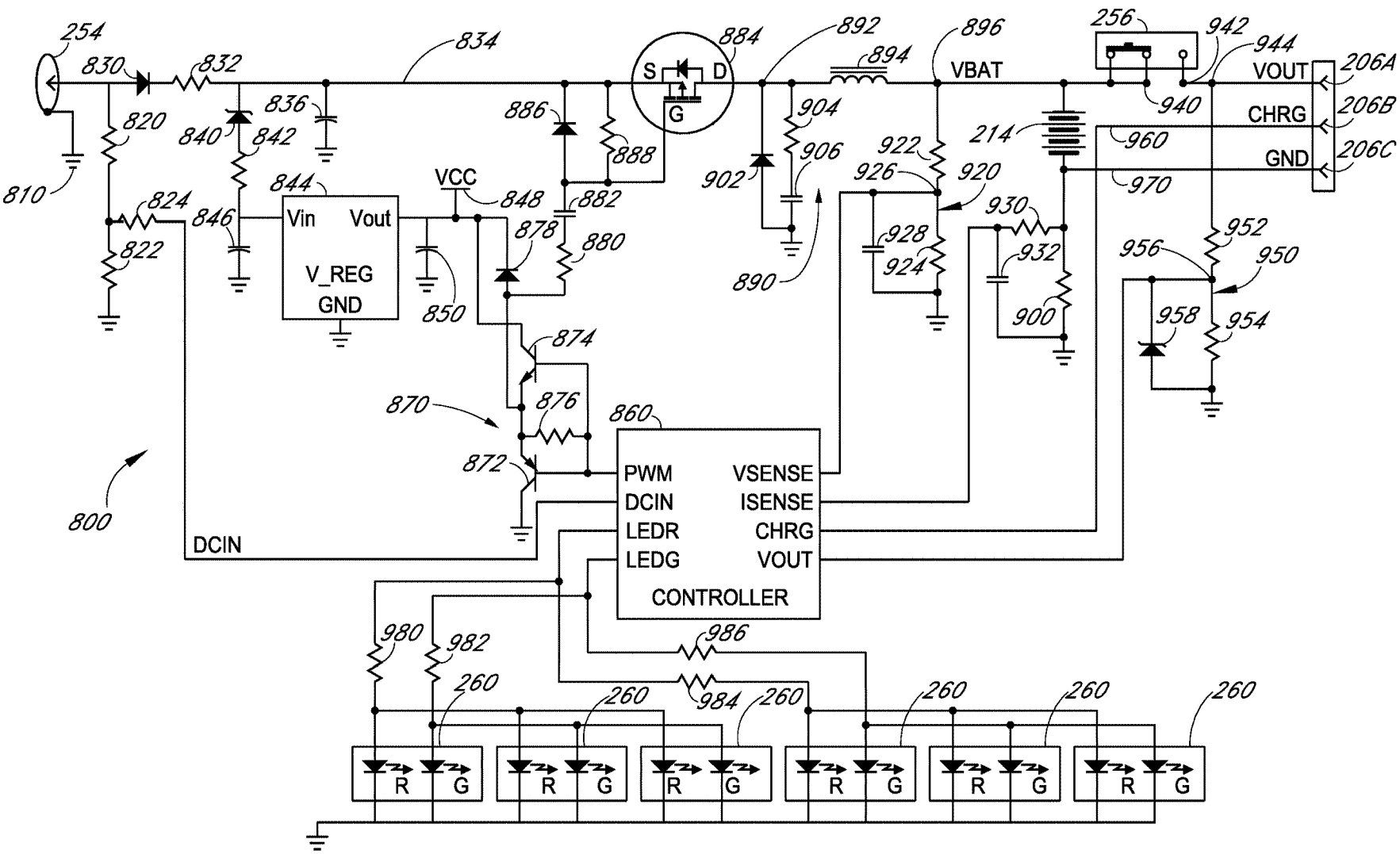
Figure 24:
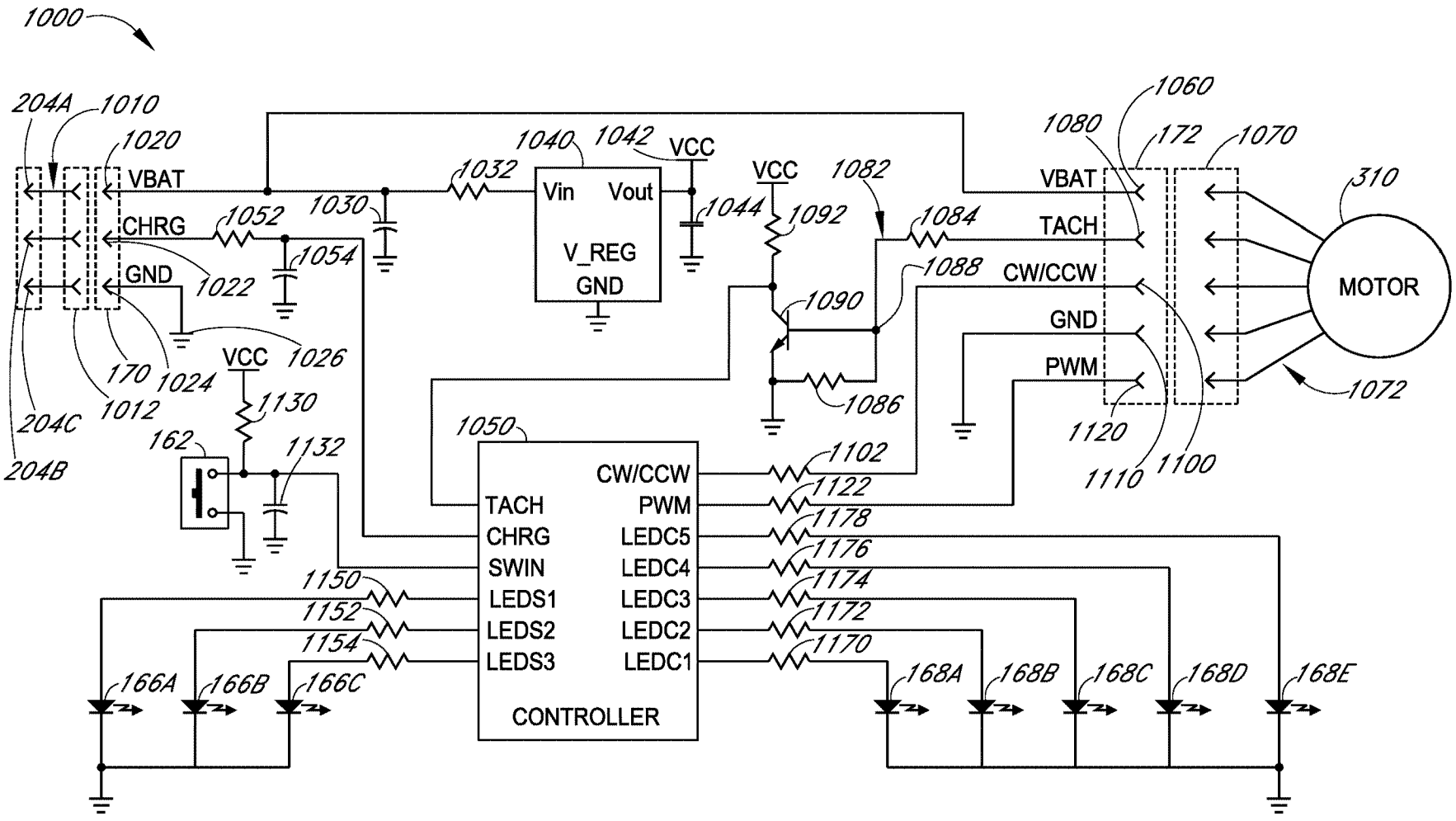

FIG. 19 illustrates a plan view of the portable electromechanical percussive massage applicator similar to the views of FIGS. 16,17 and 18, the view in FIG. 19 showing the crank in the 9 o'clock position (as viewed in FIG. 19) such the applicator head is extended a fourth distance from the housing of the applicator, wherein the fourth distance is substantially equal to the second distance of FIG. 17;

FIG. 20 illustrates a left elevational view of the percussive massage applicator of FIGS. 1 and 2 with the bullet-shaped applicator removed and replaced with a spherical applicator;

FIG. 21 illustrates a left elevational view of the percussive massage applicator of FIGS. 1 and 2 with the bullet-shaped applicator removed and replaced with a convex applicator having a larger surface area than the bullet-shaped applicator;

FIG. 22 illustrates a left elevational view of the percussive massage applicator of FIGS. 1 and 2 with the bullet-shape applicator removed and replaced with a two-pronged applicator having two smaller distal surface areas;

FIG. 23 illustrates a schematic diagram of the battery controller circuit; and FIG. 24 illustrates a schematic diagram of the motor controller circuit.

DESCRIPTION OF ILLUSTRATED EMBODIMENTS

As used throughout this specification, the words "upper," "lower," "longitudinal," "upward," "downward," "proximal," "distal," and other similar directional words are used with respect to the views being described. It should be understood that the percussive massage applicator described herein can be used in various orientations and is not limited to use in the orientations illustrated in the drawing figures.

A portable electromechanical percussive massage applicator ("percussive massage applicator") 100 is illustrated in FIGS. 1-22. As described below, the percussive massage applicator can be applied to different locations of body to apply percussion to the body to effect percussive treatment. The percussive massage applicator is operable with removably attachable applicator heads to vary the effect of the percussive strokes. The percussive massage applicator operates at a plurality of speeds (e.g., three speeds).

The portable electromechanical percussive massage applicator 100 includes a main body 110. The main body includes an upper body portion 112 and a lower body portion 114. The two body portions engage to form a generally cylindrical enclosure about a longitudinal axis 116 (FIG. 2).

Figure 3:
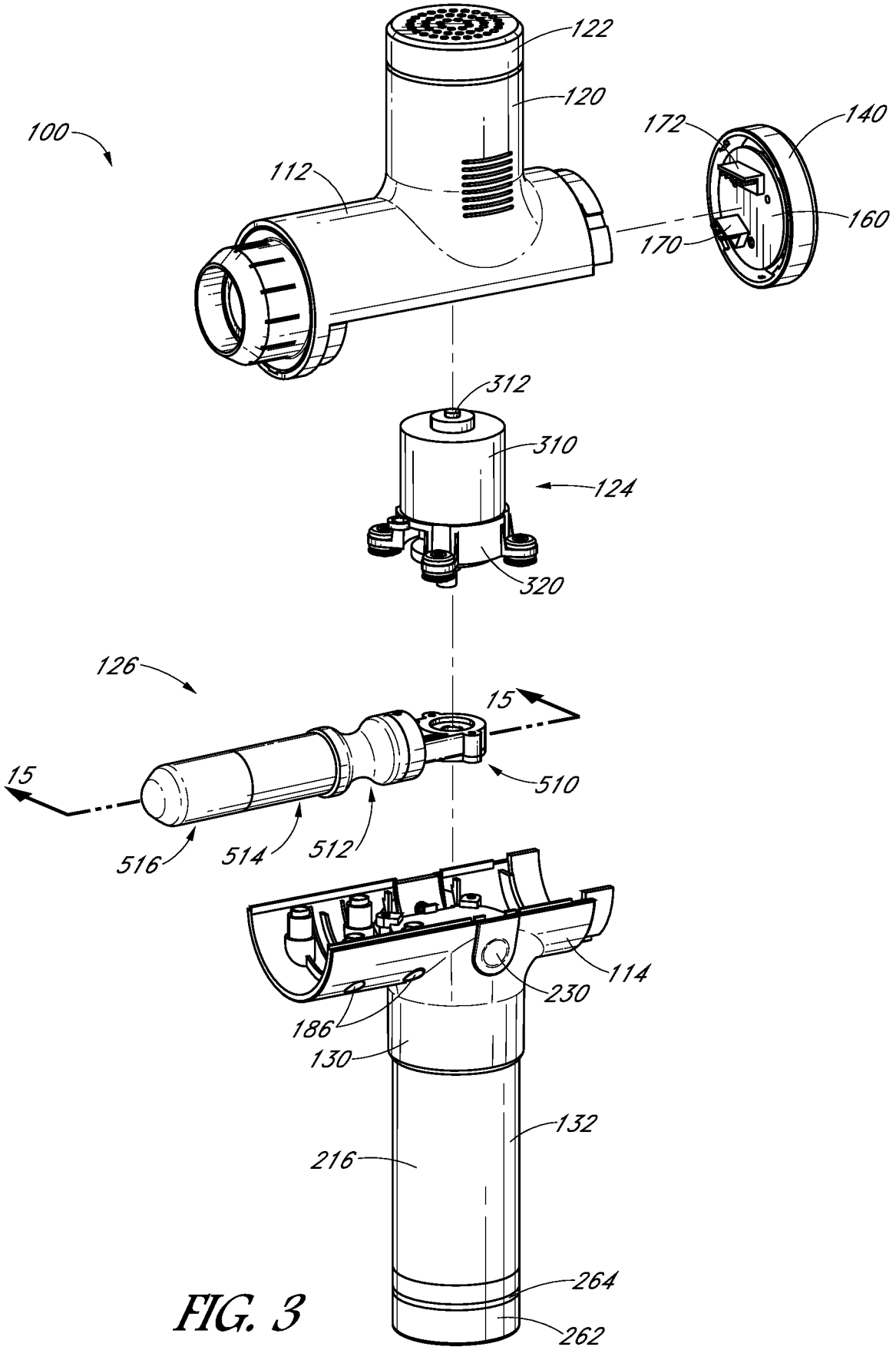
FIG. 3 illustrates an exploded perspective view of the portable electromechanical percussive massage applicator of FIG. 1, the view showing the upper housing, a motor assembly, a reciprocation assembly, and a lower housing with an attached battery assembly.

A generally cylindrical motor enclosure 120 extends upward from the upper body portion 112. The motor enclosure is substantially perpendicular to the upper body portion. The motor enclosure is capped with a motor enclosure endcap 122. The motor enclosure and the upper body portion house a motor assembly 124 (FIG. 3). The upper body portion also supports a reciprocation assembly 126 (FIG. 3), which is coupled to the motor assembly as described below.

A generally cylindrical battery assembly receiving enclosure 130 extends downward from the lower body portion 114 and is substantially perpendicular to the lower body portion. A battery assembly 132 extends from the battery assembly receiving enclosure.

Figure 4A:
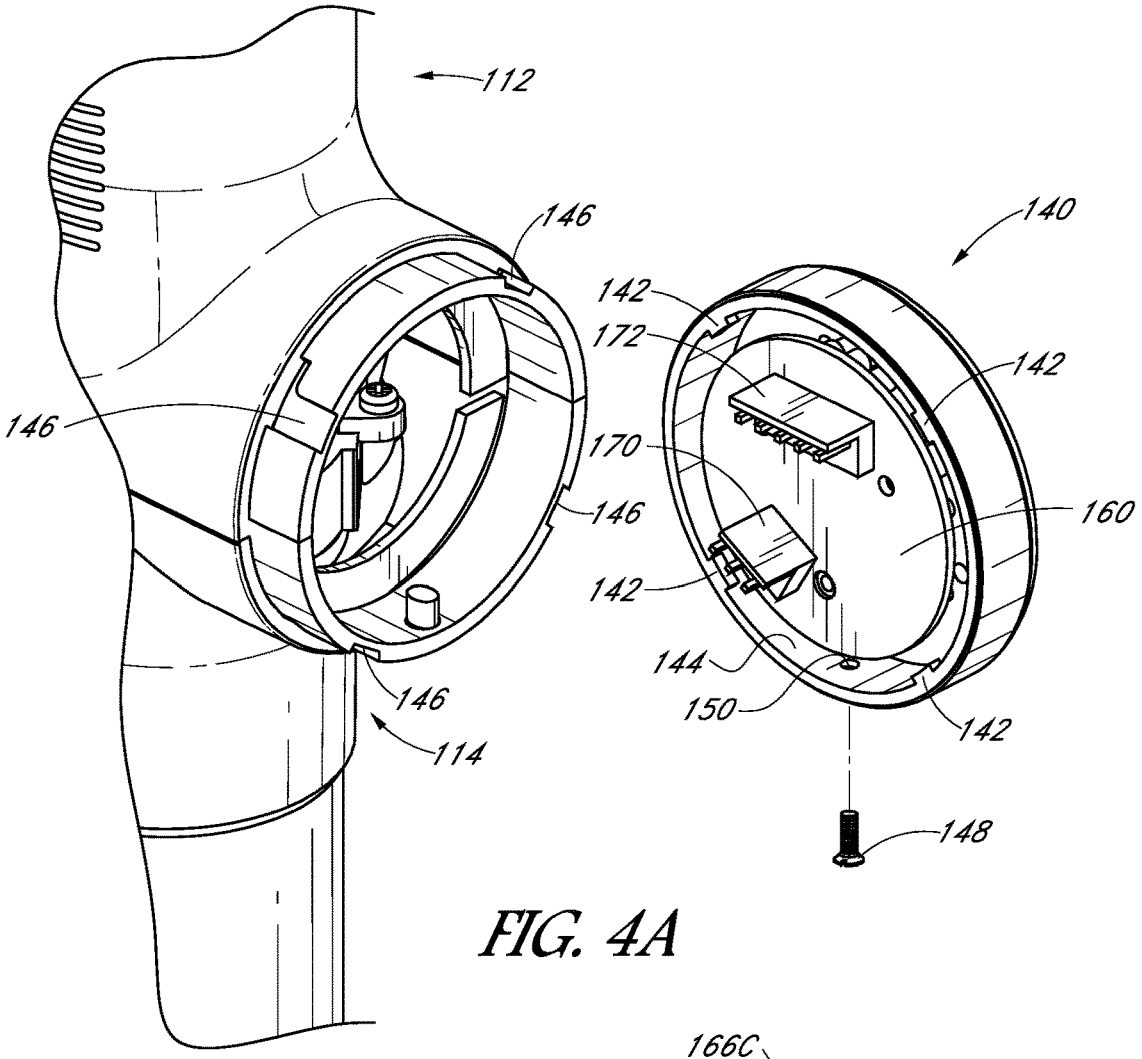
FIG. 4A illustrates an enlarged proximal end view of the combined upper and lower housing with the endcap of the housing detached and rotated to show the interlocking features, the view further showing a distal view of the main printed circuit board (PCB) positioned within the endcap of the housing.

A main body endcap 140 is positioned on a proximal end of the main body 110. In addition to other functions described below, the main body endcap also serves as a clamping mechanism to hold the respective proximal ends of the upper body portion 112 and the lower body portion 114 together. As illustrated in FIG. 4A, the endcap includes a plurality of protrusions 142 on an inner perimeter surface 144. The protrusions are positioned to engage a corresponding plurality of L-shaped notches 146 on the outer perimeters of the proximal ends of the upper body portion and the lower body portion. In the illustrated embodiment, two notches are formed on the upper body portion and two notches are formed on the lower body portion. The protrusions on the endcap are inserted into the proximal ends of the notches until seated against the distal ends of the notches. The endcap is then twisted by a few degrees (e.g., approximately 10 degrees) to lock the endcap to the two body portions. A screw 148 is then inserted through a bore 150 in the endcap to engage the lower body portion to prevent the endcap from rotating to unlock during normal use.

Figure 4B:
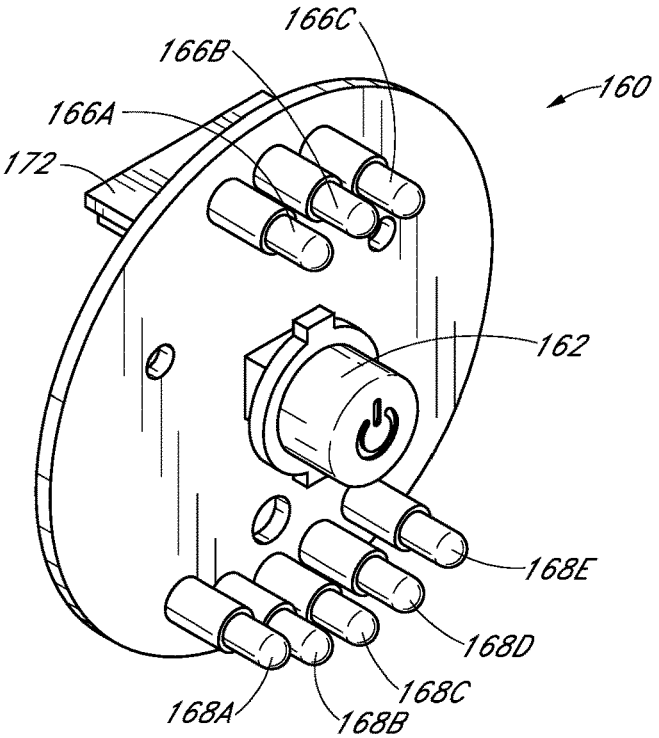
FIG. 4B illustrates a proximal view of the main PCB isolated from the endcap of the housing.

As shown in FIG. 4A, the main body endcap 140 houses a motor controller (main) printed circuit board (PCB) 160. As shown in FIG. 4B, the proximal side of the main PCB supports a central pushbutton switch 162. The operation of the switch is described below in connection with the electronic circuitry. As shown in FIG. 2, the switch is surrounded on the endcap by a plurality of bores 164, which extend perpendicularly from the outer (proximal) surface of the endcap to form a plurality of concentric rows of bores. Selected ones of the bores are through bores, which allow airflow through the endcap. Three of the bores above the switch have respective speed indication light-emitting diodes (LEDs) 166A, 166B, 166C positioned therein. The three LEDs extend from the proximal side of the PCB as shown in FIG. 4B. The three LEDs provide an indication of the operational state of the percussive massage applicator 100 as described in more detail below. Five of the bores located below the switch have respective battery charge state LEDs 168A, 168B, 168C, 168D, 168E positioned therein. The five LEDs also extend from the proximal side of the PCB as shown in FIG. 4B. The five LEDs provide an indication of the charge state of the battery when the battery assembly 132 is attached and is providing power to the percussive massage applicator. As shown in FIG. 4A, the distal side of the PCB supports a first plug 170, which includes three contact pins that are connectable to the battery assembly 132 as described below. The distal side of the PCB also supports a second plug 172, which includes five contact pins that are connectable to the motor assembly 124 as described below.

Figure 5:
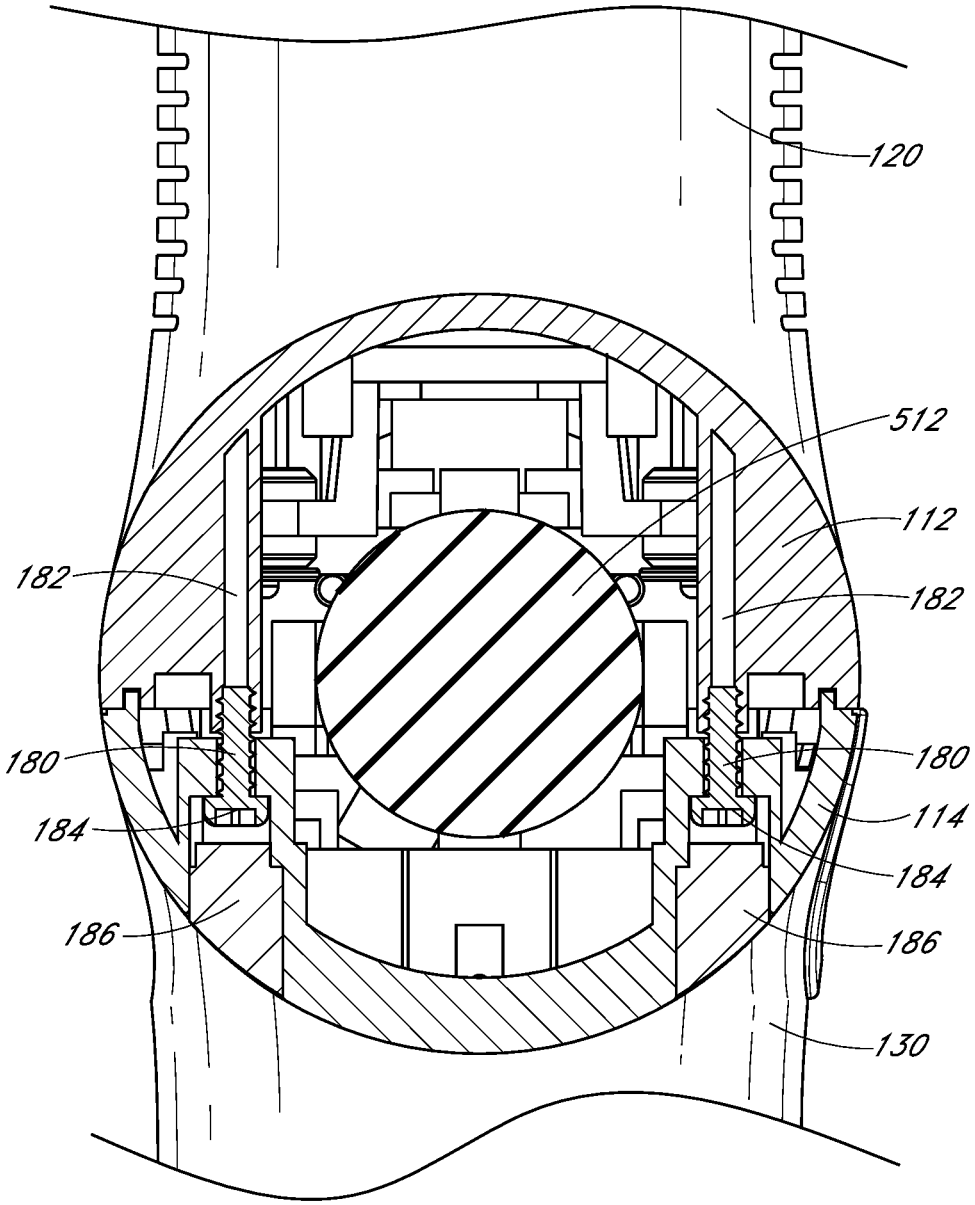
FIG. 5 illustrates an elevational cross-sectional view of the portable electromechanical percussive massage applicator of FIGS. 1 and 2 taken along the line 5-5 in FIG. 1, the view taken through a set of the mated interconnecting features of the upper and lower housings.
Figure 8:
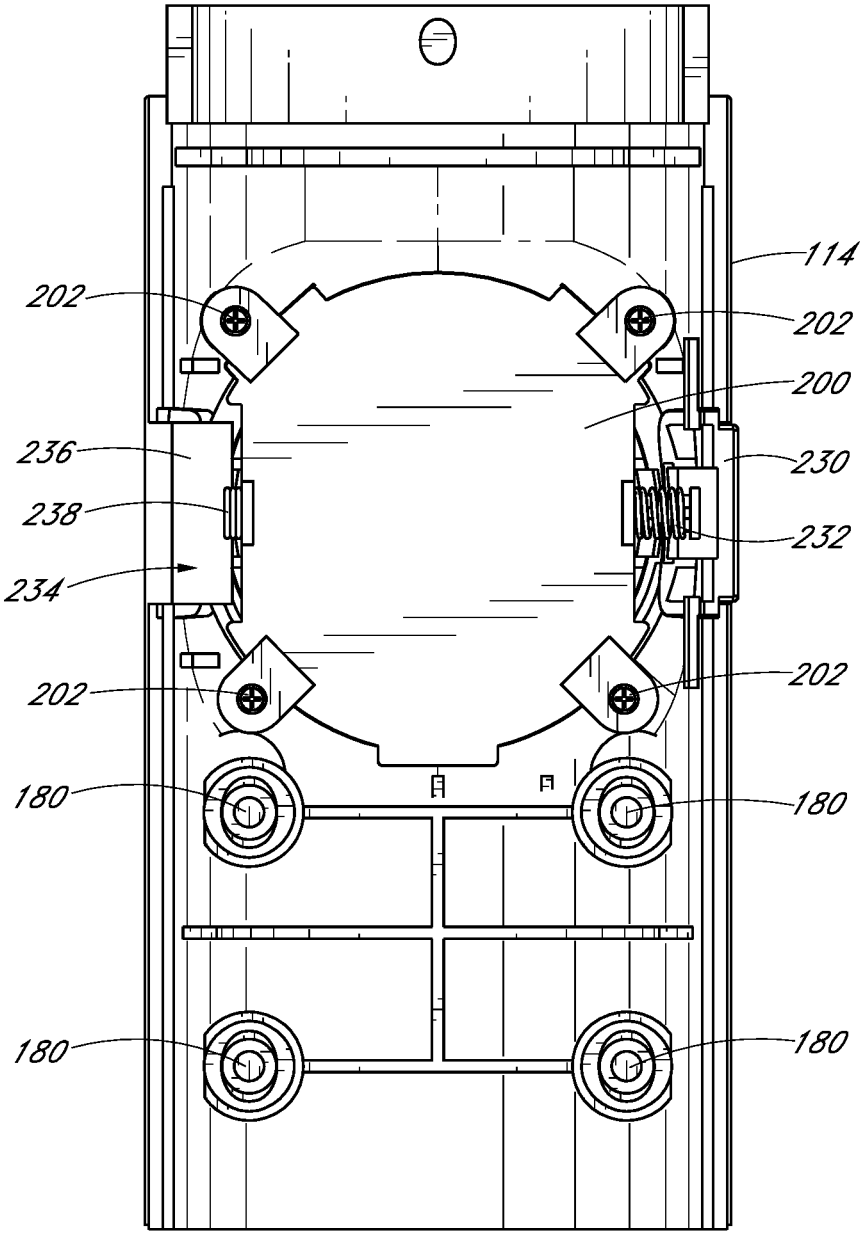
FIG. 8 illustrates a top plan view of the lower housing of FIG. 3.

As shown in FIGS. 5 and 8, a distal portion of the lower body portion 114 includes a plurality of through bores 180 (e.g., four through bores) that are aligned with a corresponding plurality of through bores 182 in the upper body portion 112. When lower body portion is attached to the upper body portion, a plurality of interconnection screws 184 pass through the through bores in the lower body portion and engage the through bores of the upper body portion to further secure the two body portions together. A plurality of plugs 186 are inserted into outer portions of the through bores of the lower body portion to hide the ends of the interconnection screws.

Figure 9:
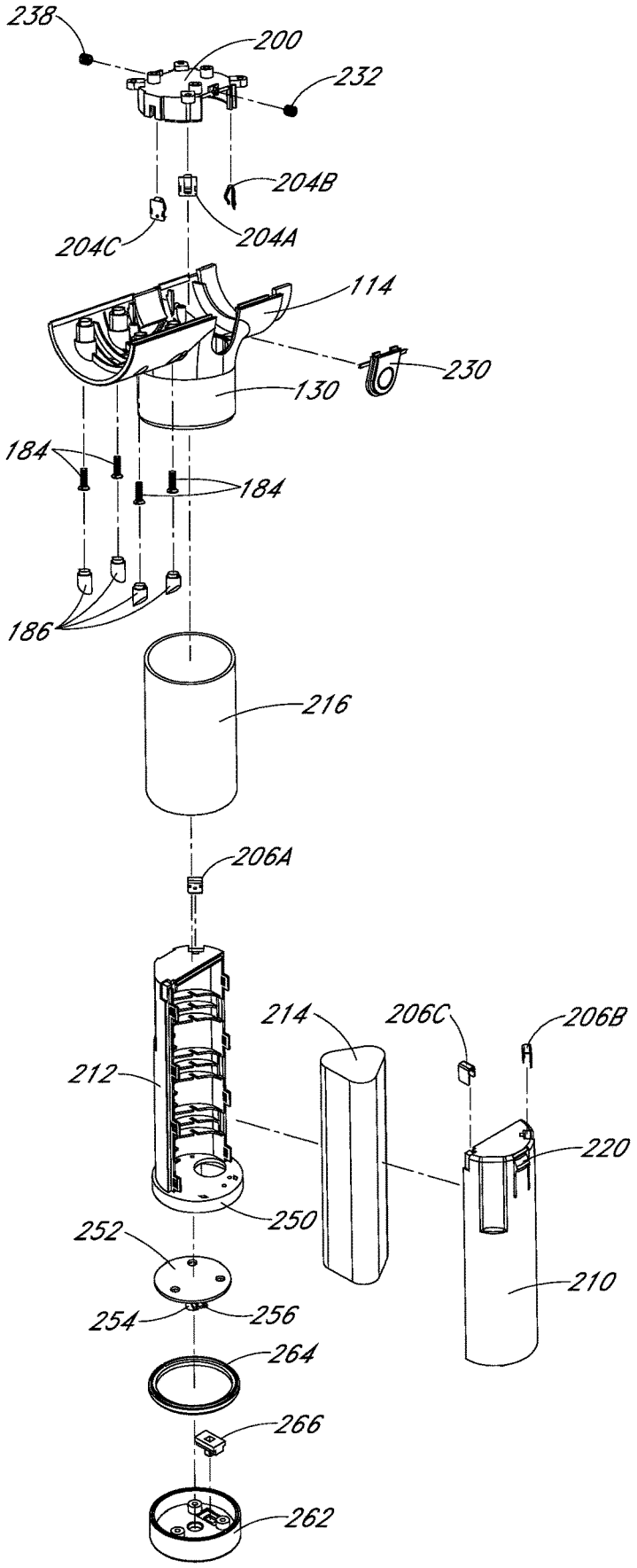
FIG. 9 illustrates an exploded perspective view of the lower housing and the battery assembly of FIG. 3.
Figure 10:
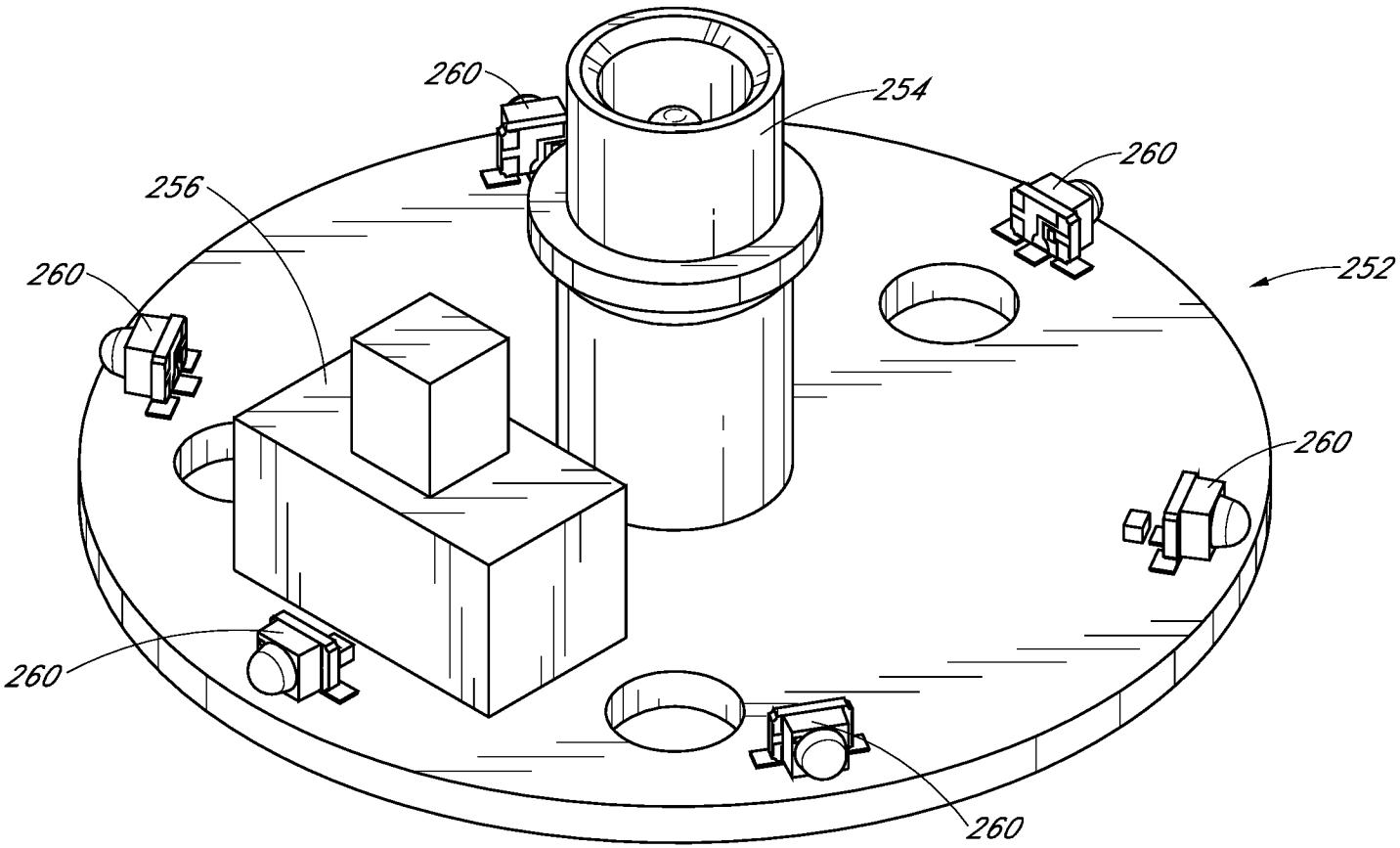
FIG. 10 illustrates an enlarged perspective view of the lower surface of the battery assembly printed circuit board.

As shown in FIGS. 8 and 9, the lower body portion 114 includes a battery assembly receiving tray 200, which is secured to the inside of the lower body portion in alignment with the battery assembly receiving enclosure 130. The receiving tray is secured to the lower body portion with a plurality of screws 202 (e.g., four screws). The receiving tray includes a plurality of leaf spring contacts 204A, 204B, 204C (e.g., three contacts), which are positioned in a triangular pattern. The three contacts are positioned to engage a corresponding plurality of contacts 206A, 206B, 206C, which are positioned around the top edge of the battery assembly 132 when the battery assembly is positioned in the battery assembly receiving enclosure.

The battery assembly 132 includes a first battery cover half 210 and a second battery cover half 212, which enclose a battery unit 214. In the illustrated embodiment, the battery unit comprises six 4.2-volt lithium-ion battery cells connected in series to produce an overall battery voltage of approximately 25.2 volts when fully charged. The battery cells are commercially available from many suppliers, such as, for example, Samsung SDI Co., Ltd., of South Korea. The first battery cover half and the second battery cover half snap together. The two halves are further held together by an outer cylindrical cover 216, which also serves as a gripping surface when the percussive massage applicator 100 is being used. In the illustrated embodiment, the outer cover extends only over the portion of the battery assembly that does not enter the battery receiving enclosure 132. In the illustrated embodiment, the outer cover comprises neoprene or another suitable material that combines a cushioning layer with an effective gripping surface.

Figure 6:
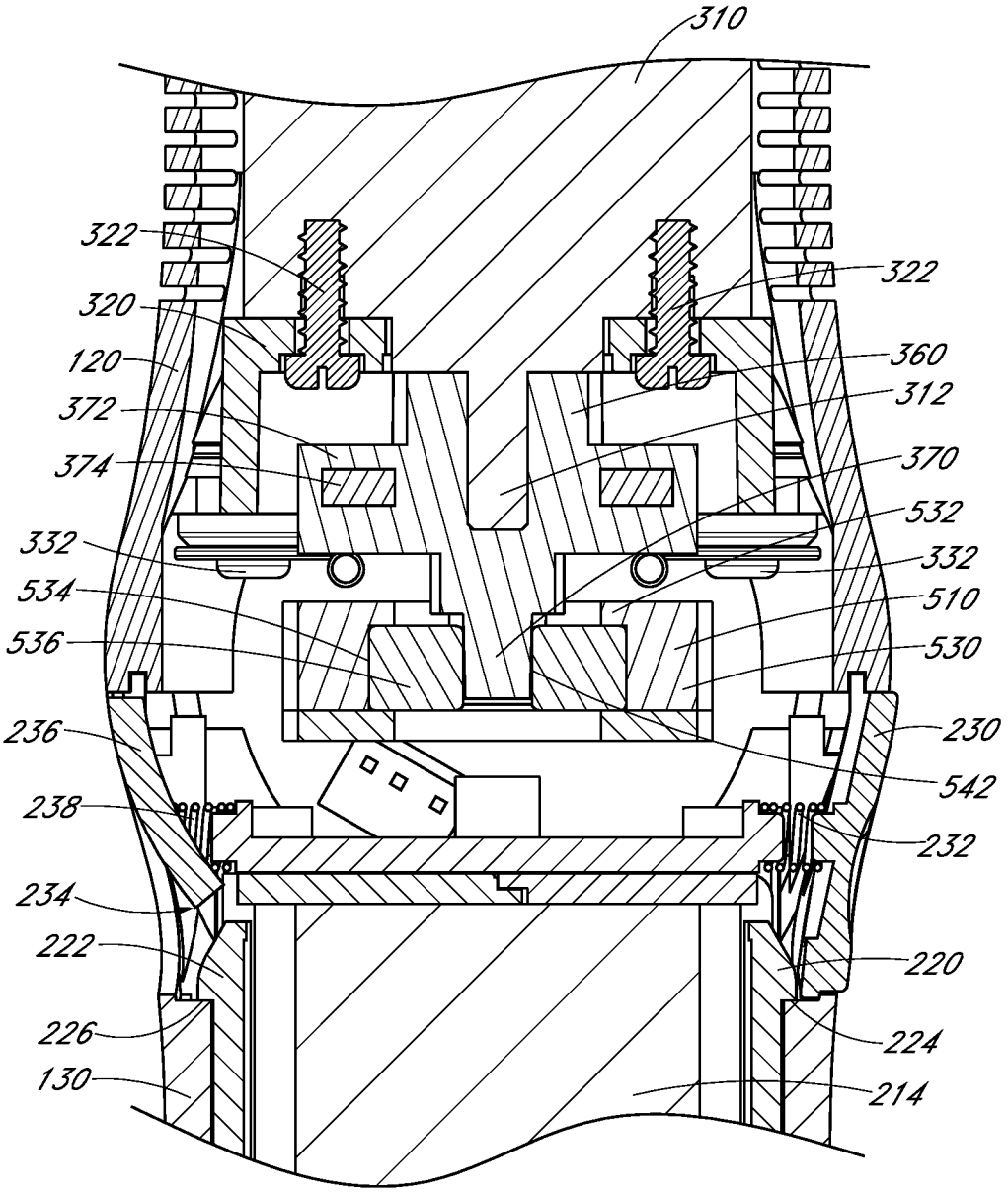
FIG. 6 illustrates an elevational cross-sectional view of the portable electromechanical percussive massage applicator of FIGS. 1 and 2 taken along the line 6-6 in FIG. 1, the view taken through the centerline of the shaft of the motor in the motor assembly of FIG. 3.

The upper end of the battery assembly 132 includes a first mechanical engagement tab 220 and a second mechanical engagement tab 222 (FIG. 6). As shown in FIG. 6, for example, when the battery assembly is fully inserted into the battery assembly receiving enclosure 130, the first engagement tab engages a first ledge 224 and the second engagement tab engages a second ledge 226 within the battery assembly receiving enclosure to secure the battery assembly within the battery assembly receiving enclosure.

The lower body portion 114 includes a mechanical button 230 in alignment with the first engagement tab 220. When sufficient pressure is applied to the button, the first engagement tab is pushed away from the first ledge 224 to allow the first engagement tab to move downward with respect to the first ledge and thereby disengage from the ledge. In the illustrated embodiment, the mechanical button is biased by a compression spring 232. The lower body portion further includes an opening 234 (FIG. 6) opposite the mechanical button. The opening allows a user to insert a fingertip into the opening to apply pressure to disengage the second engagement tab 222 from the second ledge 226 and at the same time to apply downward pressure to move the second engagement tab downward away from the second ledge and thereby move the battery assembly 132 downward. Once disengaged in this manner, the battery assembly is easily removed from the battery assembly receiving enclosure 130. In the illustrated embodiment, the opening is covered in part by a flap 236. The flap may be biased by a compression spring 238. In alternative embodiments (not shown), a second mechanical button may be included in place of the opening.

The second battery cover half 212 includes an integral printed circuit board support structure 250, which supports a battery controller printed circuit board (PCB) 252. The battery controller PCB is shown in more detail in FIG. 10. In addition to other components, the battery controller PCB includes a charging power adapter input jack 254 and an on/off switch 256. In the illustrated embodiment, the on/off switch is a slide switch. The battery controller PCB further supports a plurality of light-emitting diodes (LEDs) 260 (e.g., six LEDs), which are mounted around the periphery of the battery controller PCB. In the illustrated embodiment, each LED is a dual-color LED (e.g., red and green), which may be illuminated to display either color. The battery controller PCB is mounted to a battery assembly endcap 262. A translucent plastic ring 264 is secured between the battery controller PCB and the battery assembly endcap such that the ring generally aligned with the LEDs. Accordingly, light emitted by the LEDs is emitted through the ring. As discussed below, the color of the LEDs may be used to indicate the charged state of the battery assembly 132. A switch actuator extender 264 is positioned on the actuator of the slide switch and extends through the endcap to enable the slide switch to be manipulated from the outside of the endcap.

Figure 11A:
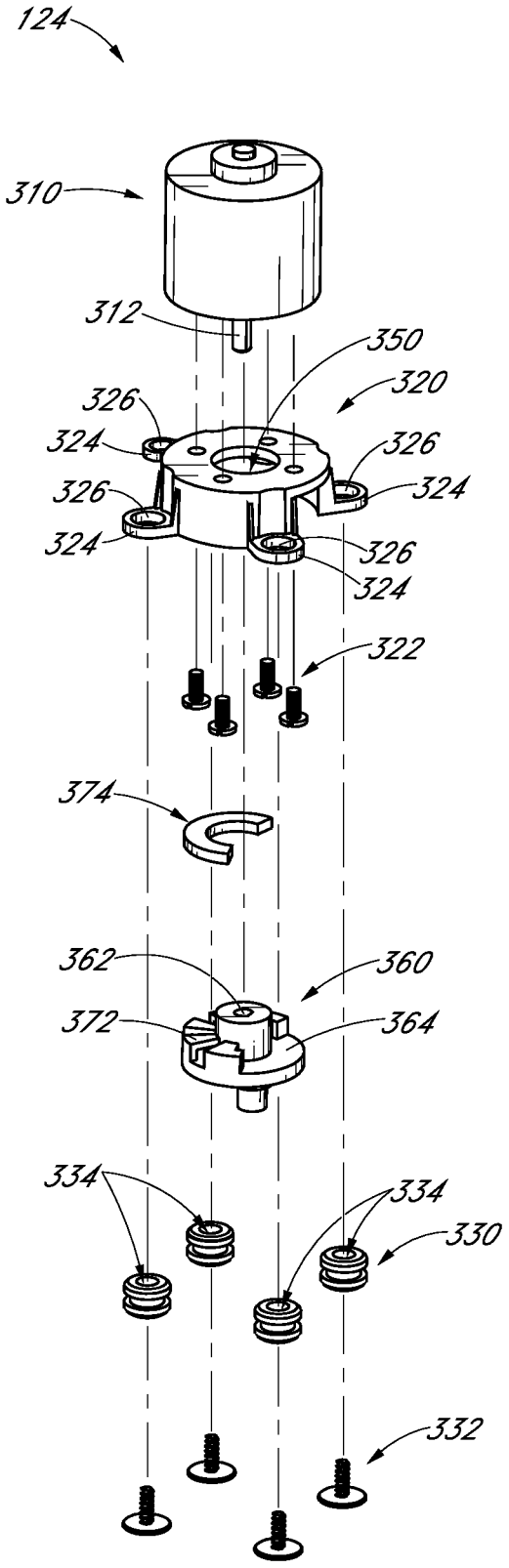
FIG. 11A illustrates an exploded top perspective view of the motor assembly of FIG. 3, the view showing the upper surfaces of the elements of the motor assembly.
Figure 11B:
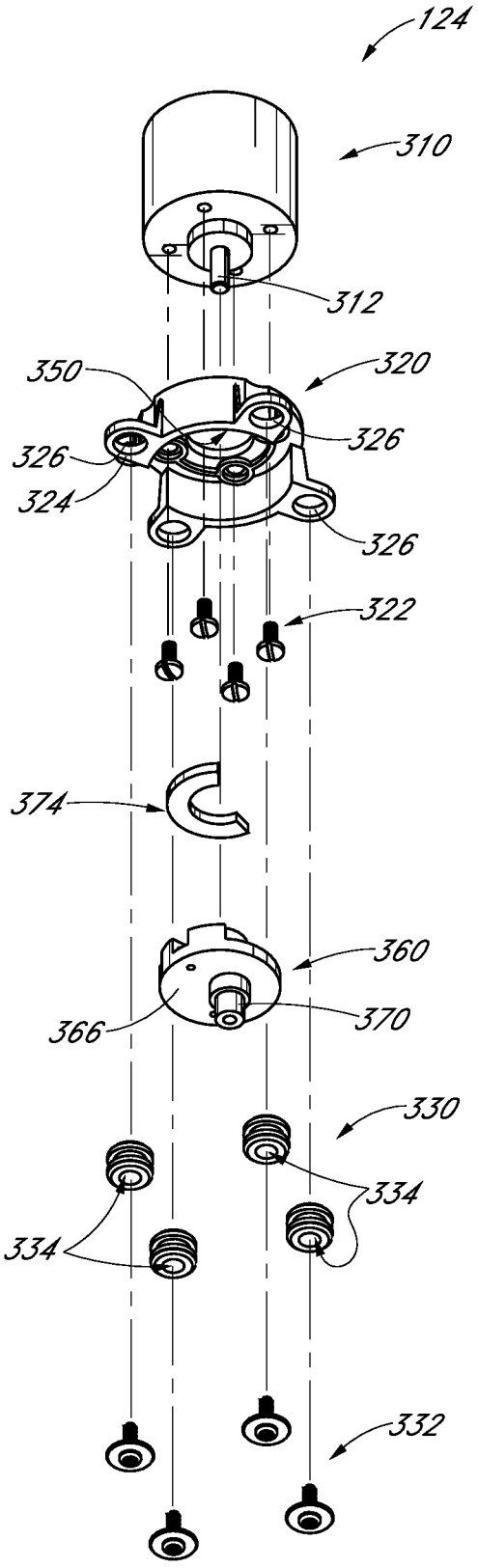
FIG. 11B illustrates an exploded bottom perspective view of the motor assembly of FIG. 3, the view of FIG. 11B similar to the view of FIG. 11A with the elements of the motor assembly rotated to show the lower surfaces of the elements.

As illustrated in FIG. 3, the motor enclosure 120 houses the electric motor assembly 124, which is shown in more detail in FIGS. 11A and 11B. The electric motor assembly includes a brushless DC electric motor 310 having a central shaft 312 that rotates in response to applied electrical energy. In the illustrated embodiment, the electric motor is a 24-volt brushless DC motor. The electric motor may be a commercially available motor. The diameter and height of the motor enclosure and the mounting structures (described below) are adaptable to receive and secure the electric motor within the motor enclosure.

Figure 12:
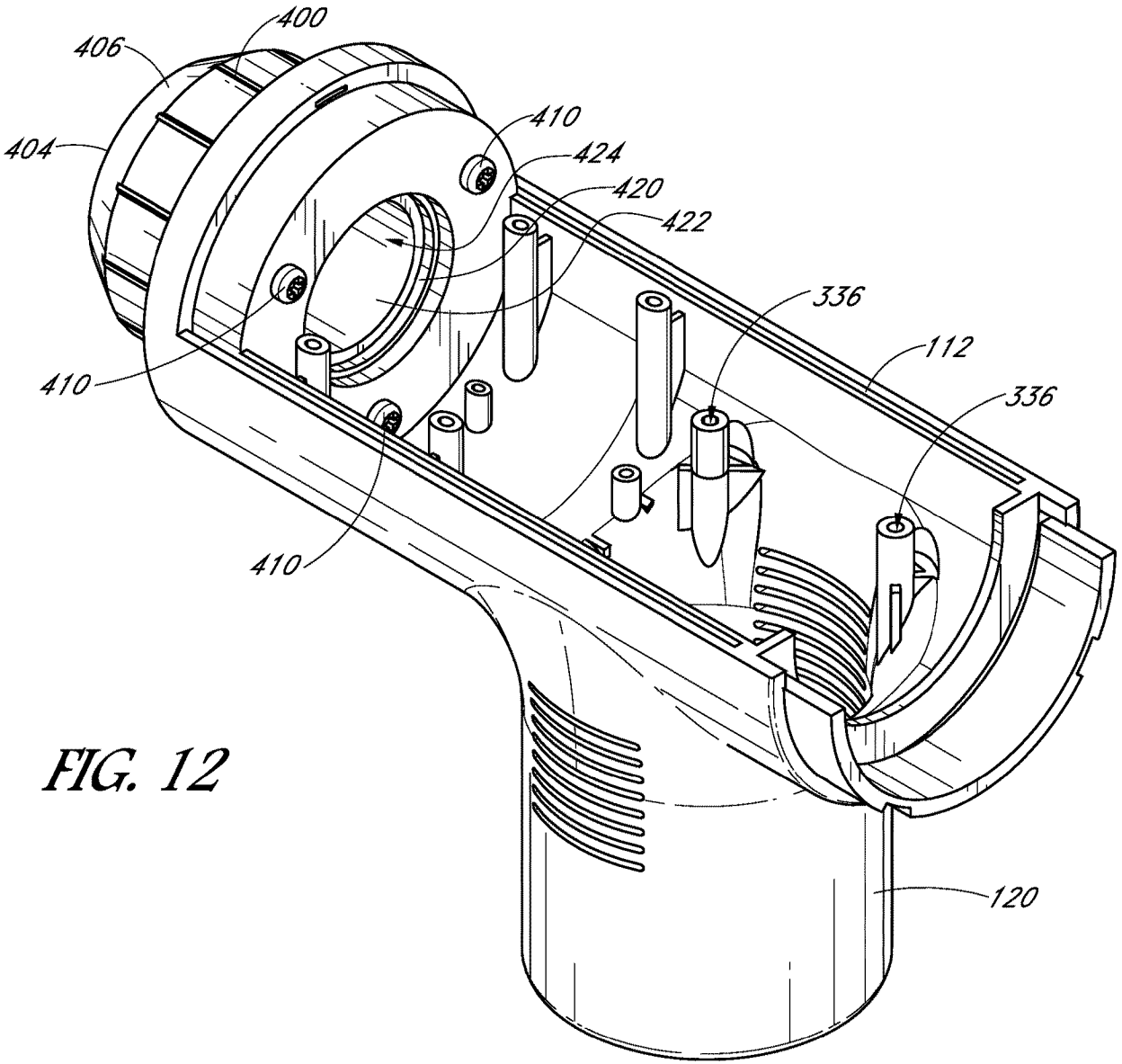
FIG. 12 illustrates a bottom perspective view of the upper housing of the percussive massage applicator viewed from the proximal end.

The electric motor 310 is secured to a motor mounting bracket 320 via a plurality of motor mounting screws 322. The motor mounting bracket includes a plurality of mounting tabs 324 (e.g., four tabs). Each mounting tab includes a central bore 326, which receives a respective rubber grommet 330, wherein first and second enlarged portions of the grommet are positioned on opposite surfaces of the tab. A respective bracket mounting screw 332 having an integral washer is passed through a respective central hole 334 in each grommet to engage a respective mounting bore 336 in the upper body portion 112. Two of the four mounting bores are shown in FIG. 12. The grommets serve as vibration dampers between the motor mounting bracket and the upper body portion.

The central shaft 312 of the electric motor 310 extends through a central opening 350 in the motor mounting bracket 320. The central shaft engages a central bore 362 of an eccentric crank 360. The central bore is press-fit onto the central shaft of the electric motor or is secured to the shaft by another suitable technique (e.g., using a setscrew).

The eccentric crank 360 has a circular disk shape. The crank has an inner surface 364 oriented toward the electric motor and an outer surface 366 oriented away from the electric motor. A cylindrical crank pivot 370 is secured to or formed on the outer surface and is offset from the central bore of the crank in a first direction by a selected distance (e.g., 2.8 millimeters in the illustrated embodiment). An arcuate cage 372 extends from the inner surface of the crank and is generally positioned diametrically opposite the crank pivot with reference to the central bore 362 of the crank. A semi-annular weight ring 374 is inserted into the arcuate cage and is secured therein by screws, crimping or by using another suitable technique. The masses of the arcuate cage and the semi-annular weight ring operate to at least partially counterbalance the mass of the crank and the forces applied to the crank, as described below.

Figure 13:
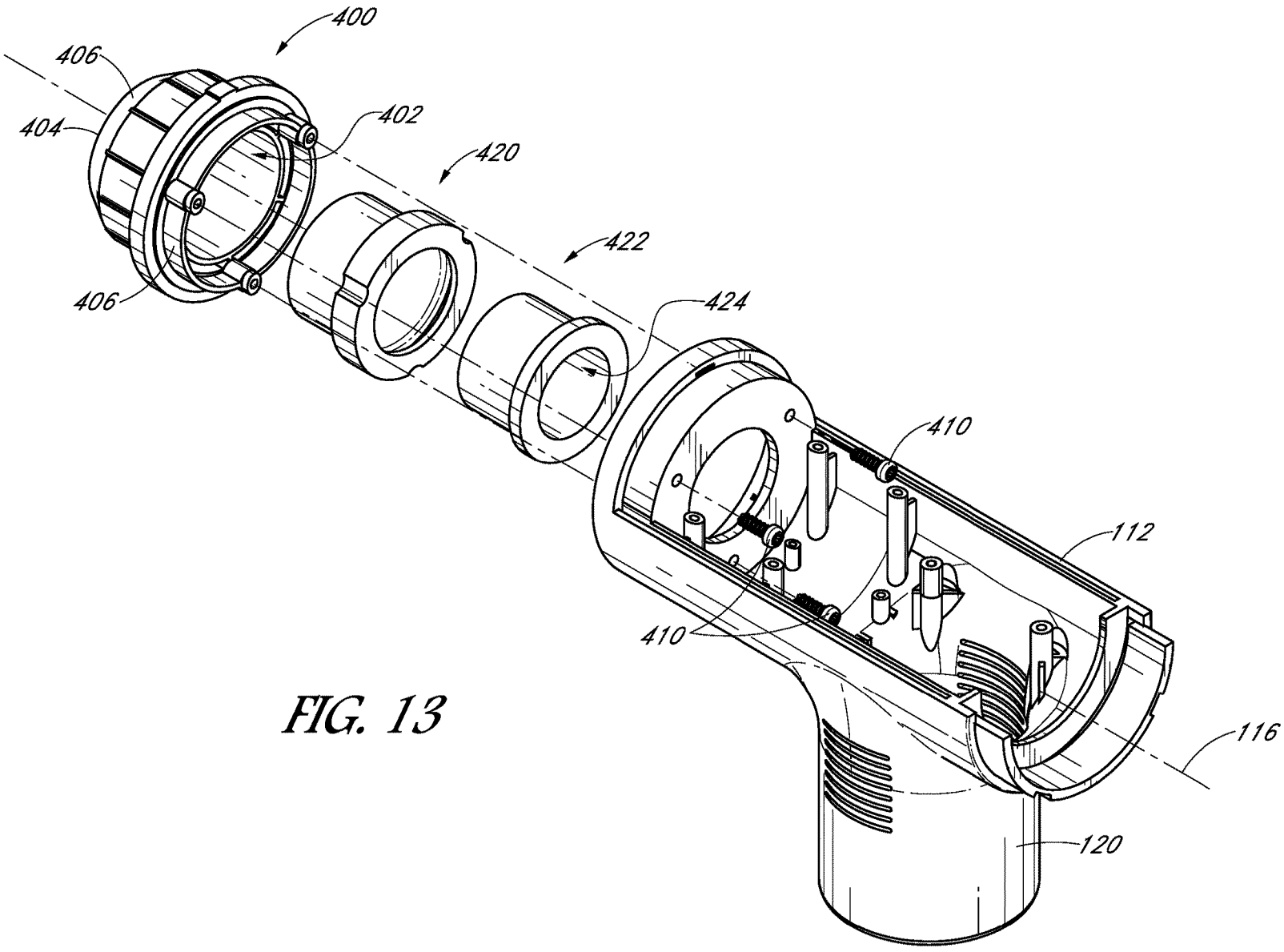
FIG. 13 illustrates an exploded perspective view of the upper housing of the percussive massage applicator corresponding to the view of FIG. 12 showing the outer sleeve, the cylindrical mounting sleeve and the cylinder body.
Figure 14:
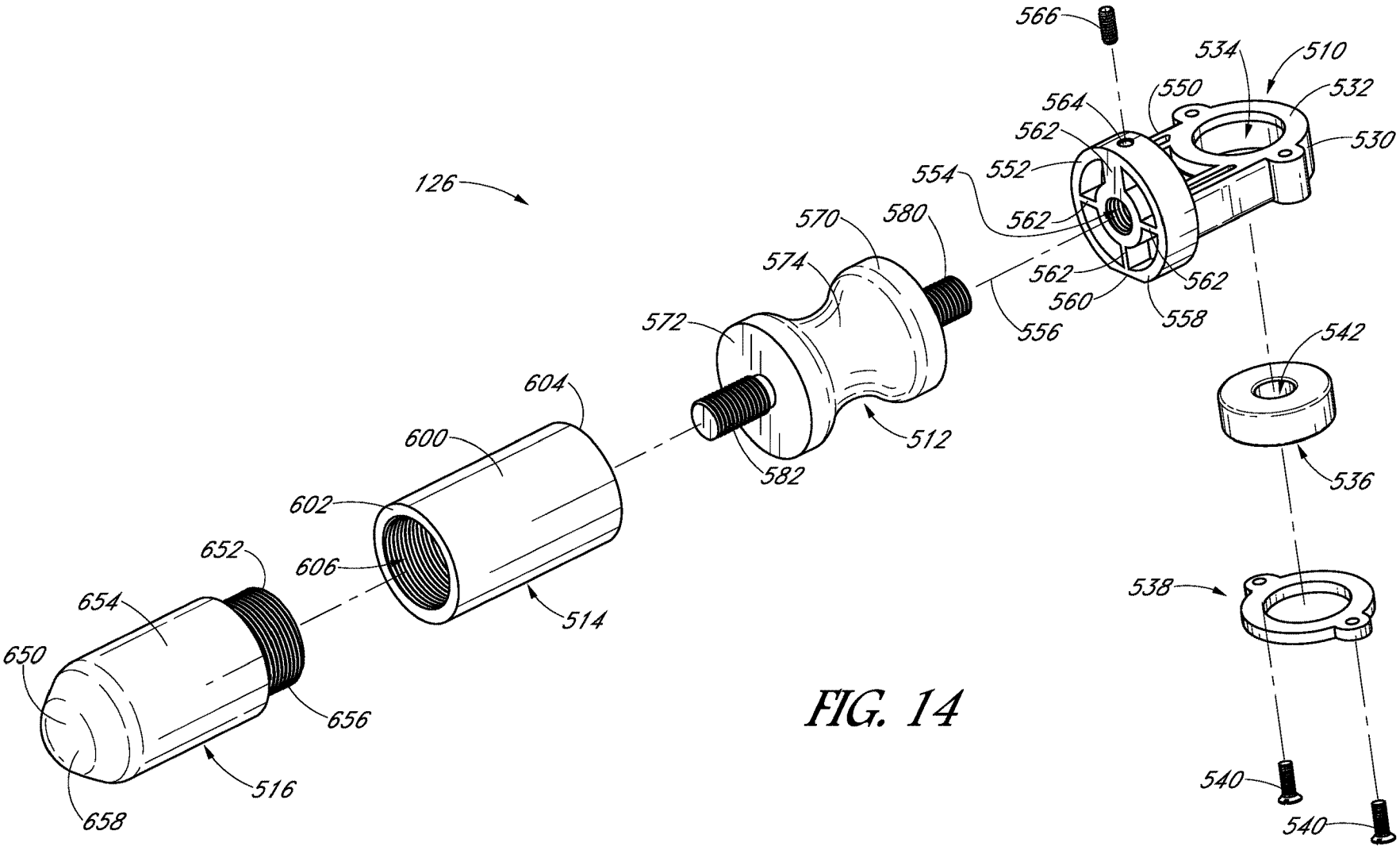
FIG. 14 illustrates an exploded perspective view of the reciprocation assembly of FIG. 3, the reciprocation assembly including a crank bracket, a flexible interconnection linkage, a piston and a removably attachable application head.
Figure 15:
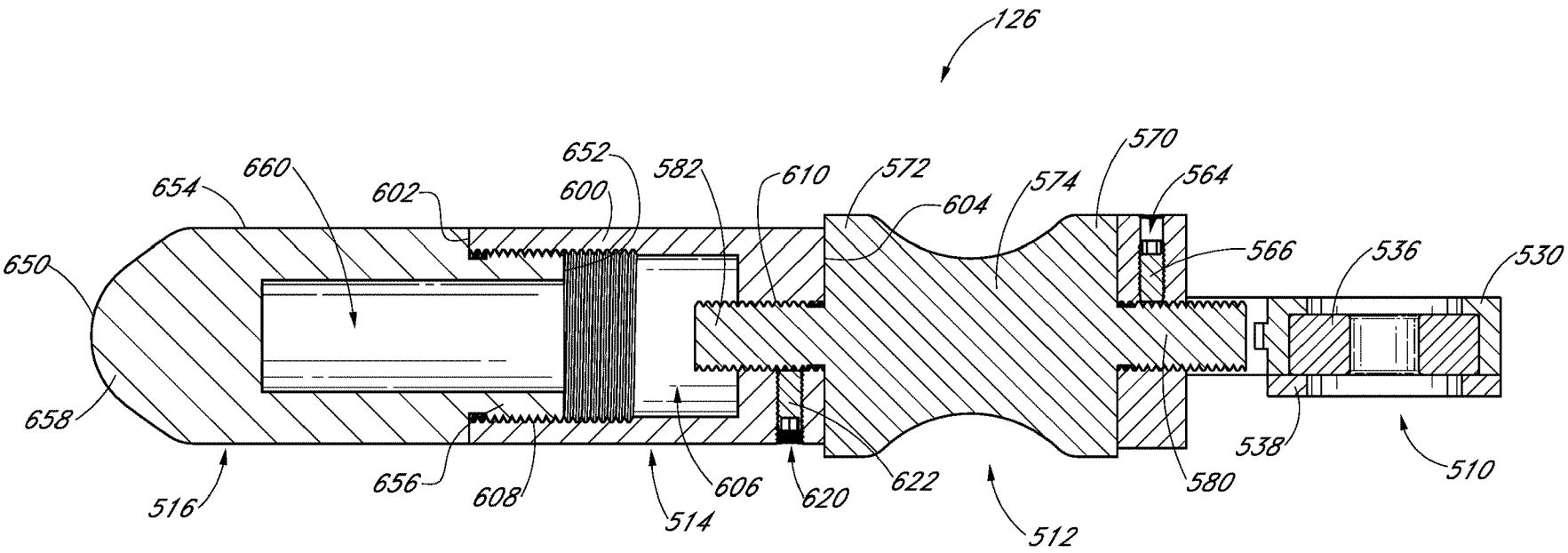
FIG. 15 illustrates a cross-sectional view of the assembled reciprocation assembly taken along the line 15-15 in FIG. 3.

As shown in FIGS. 12 and 13, the distal end of the upper body portion 112 supports a generally cylindrical outer sleeve 400 having a central bore 402. In the illustrated embodiment, a distal portion 406 proximate to a distal end 404 of the outer sleeve is tapered inward toward the central bore. The outer sleeve has an annular base 408 that is secured to the distal end of the upper body portion by a plurality of screws 410 (e.g., three screws).

The outer sleeve 400 surrounds a generally cylindrical mounting sleeve 420 that is secured within the outer sleeve when the outer sleeve is secured to the upper body portion 112. The mounting sleeve surrounds a cylinder body 422 that is clamped by the mounting sleeve and is secured in a concentric position with respect to the longitudinal axis 116 of the percussive massage applicator 100. In addition to securing the cylinder body, the mounting sleeve serves as a vibration damper to reduce vibrations propagating from the cylinder body to the main body 110 of the percussive massage applicator. In the illustrated embodiment, the cylinder body has a length of approximately 25 millimeters and has an inner bore 424, which has an inner diameter of approximately 25 millimeters. In particular, the inner diameter of the cylinder body is at least 25 millimeters plus a selected clearance fit (e.g., approximately 25 millimeters plus approximately 0.2 millimeters).

As shown in FIG. 3, the percussive massage applicator 100 includes the reciprocating assembly 126, which comprises a crank engagement bearing holder 510, which may also be referred to as a transfer bracket; a flexible interconnection linkage 512, which may also be referred to as a flexible transfer linkage; a piston 514; and an applicator head 516. The reciprocating assembly is shown in more detail in FIGS. 14 and 15.

The crank engagement bearing holder 510 comprises a bearing housing 530 having an upper end wall 532 that defines the end of a cylindrical cavity 534. An annular bearing 536 fits within the cylindrical cavity. A removably attachable lower end wall 538 is secured to the bearing housing by a plurality of screws 540 (e.g., two screws) to constrain the annual bearing within the cylindrical cavity. The annular bearing includes a central bore 542 that is sized to engage the cylindrical crank pivot 370 of the eccentric crank 360.

The crank engagement bearing holder 510 further includes an interconnect portion 550 that extends radially from the bearing housing 530. The interconnect portion includes a disk-shaped interface portion 552 having a threaded longitudinal central bore 554. The central bore is aligned with a radial line 556 directed toward the center of bearing housing. In the illustrated embodiment, the central bore is threaded with an 8×1.0 metric external thread. The interface portion has an outer surface 558, which is orthogonal to the radial line. The center of the outer surface of the interface portion is approximately 31 millimeters from the center of the bearing housing. The interface portion has an overall diameter of approximately 28 millimeters and has a thickness of approximately 8 millimeters. A lower portion 560 of the interface portion may be flattened to provide clearance with other components. Selected portions of the interface portion may be removed to form ribs 562 to reduce the overall mass of the interface portion.

A threaded radial bore 564 is formed in the interface portion 552. The threaded radial bore extends from the outer perimeter of the interface portion to the threaded longitudinal central bore 554. The threaded radial bore has an internal thread selected to engage a bearing holder setscrew 566 that is inserted into the third threaded bore. The bearing holder setscrew is rotated to a selected depth as described below.

As used herein, "flexible" in connection with the flexible interconnection linkage 512 means that the linkage is capable of bending without breaking. The linkage comprises a resilient rubber material. The linkage may have a Shore A durometer hardness of around 50; however, softer or harder materials in a medium soft Shore hardness range of 35A to 55A may be used. The linkage is molded or otherwise formed to have a shape similar to an hourglass. That is, the shape of the linkage is relatively larger at each end and relatively narrower in the middle. In the illustrated embodiment, the linkage has a first disk-shaped end portion 570 and a second disk-shaped end portion 572. In the illustrated embodiment, the two end portions have similar thicknesses of approximately 4.7 millimeters and have similar outer diameters of approximately 28 millimeters. The material between the two end portions tapers to middle portion 574, which has a diameter of approximately 18 millimeters. In general, the middle portion has a diameter that is between 50 percent and 75 percent of the diameter of the end portions; however, the middle portion may be relatively smaller or relatively larger to accommodate materials having a greater hardness or a lesser hardness. The linkage has an overall length between the outer surfaces of the two end portions of approximately 34 millimeters. As discussed in more detail below, the smaller diameter middle portion of the linkage allows the linkage to flex easily between the two end portions.

A first threaded interconnect rod 580 extends from the first end portion 570 of the flexible interconnection linkage 512. A second threaded interconnect rod 582 extends from the second end portion 572 of the linkage. In the illustrated embodiment, the interconnect rods are metallic and are embedded into the respective end portions. For example, in one embodiment, the linkage is molded around the two interconnect rods. In other embodiment, the two interconnect rods are adhesively fixed within respective cavities formed in the respective end portions. In a still further embodiment, the two interconnect rods are formed as integral threaded rubber portions of the linkage.

The first interconnect rod 580 of the flexible interconnection linkage 512 has an external thread selected to engage with the internal thread of the threaded longitudinal central bore 554 of the crank engagement bearing holder 510 (e.g., an 8×1.0 metric external thread). When the thread of the first interconnect rod is fully engaged with the thread of the longitudinal central bore, the bearing holder setscrew 566 is rotated to cause the inner end of the setscrew to engage the thread of the first interconnect rod within the longitudinal central bore to inhibit the first interconnect rod from rotating out of the longitudinal central bore.

In the illustrated embodiment, the second interconnect rod 582 of the flexible interconnection linkage 512 has an external thread similar to the thread of the first interconnect rod 580 (e.g., an 8×1.0 metric external thread). In other embodiments, the threads of the two interconnect rods may be different.

In the illustrated embodiment, the piston 514 comprises stainless steel or another suitable material. The piston has an outer diameter that is selected to fit snugly within the inner bore 424 of the cylinder body 422 described above. For example, the outer diameter of the illustrated piston is no greater than approximately 25 millimeters. As discussed above, the inner diameter of the inner bore of the cylinder body is at least 25 millimeters plus a selected minimum clearance allowance (e.g., approximately 0.2 millimeter). Thus, with the outer diameter of the piston being no more than 25 millimeters, the piston has sufficient clearance with respect to the cylinder body that the piston is able to move smoothly within the cylinder body without interference. The maximum clearance is selected such that no significant play exists between the two parts.

In the illustrated embodiment, the piston 514 comprises a cylinder having an outer wall 600 that extends for a length of approximately 41.2 millimeters between a first end 602 and a second end 604. A first bore 606 is formed in the piston for a selected distance from the first end toward the second end. For example, in the illustrated embodiment, the first bore has a depth (e.g., length toward the second end) of approximately 31.2 millimeters and has a base diameter of approximately 18.773 millimeters. A first portion 608 (FIG. 15) of the first bore is threaded to form a 20×1.0 metric internal thread to a depth of approximately 20 millimeters in the first bore.

A second bore 610 (FIG. 15) is formed from the second end 604 of the piston 514 toward the first end. The second bore has a base diameter of approximately 6.917 millimeters and has a length sufficient to extend the second bore to the cavity formed by the first bore (e.g., a length of approximately 10 millimeters in the illustrated embodiment). The second bore is threaded for its entire length to form an internal thread in the second bore. The internal thread of the second bore engages the external thread of the second interconnect rod 582 of the interconnection linkage 512. Accordingly, in the illustrated embodiment, the second bore has an 8×1.0 metric internal thread.

A third bore 620 is formed in the piston 514 near the second end 604 of the piston. The third threaded bore extends radially inward from the outer wall 600 of the piston to the second threaded bore. In the illustrated embodiment, the third bore is threaded for the entire length of the bore. The third bore has an internal thread selected to engage a piston setscrew 622, which is inserted into the third threaded bore. When the external thread of the second interconnect rod 582 of the flexible interconnection linkage 512 is fully engaged with the internal thread of the second bore 610 of the piston, the piston setscrew is rotated to cause the inner end of the setscrew to engage the external thread of the second interconnect rod within the second bore to inhibit the second interconnect rod from rotating out of engagement with the thread of the second bore.

The applicator head 516 of the reciprocating assembly 500 can be configured in a variety of shapes to enable a user to apply different types of percussive massage. The illustrated applicator head is "bullet-shaped" and is useful for apply percussive massage to selected relatively small surface areas of a body such as, for example, trigger points. In the illustrated embodiment, the applicator head comprises a medium hard to hard rubber material. The applicator head has an overall length from a first distal (application) end 650 to a second proximal (mounting) end 652 of approximately 55 millimeters. The applicator head has an outer diameter of approximately 25 millimeters for a length of approximately 32 millimeters along a main body portion 654. An engagement portion 656 at the proximal (mounting) end of the applicator head has a length of approximately 11 millimeters and is threaded for a distance of approximately 9 millimeters to form an external 20×1.0 metric thread that is configured to engage the internal thread of the first bore 606 of the piston 514. The thread of the applicator head is removably engageable with the thread of the piston to allow the applicator head to be removed and replaced with a different applicator head as described below. The distal (applicator) end of the applicator has a length of approximately 12 millimeters and tapers from the diameter of the main body portion (e.g., approximately 25 millimeters to a blunt rounded portion 658 having the shape of a truncated spherical cap. The spherical cap extends distally for approximately 3.9 millimeters. The spherical cap has a longitudinal of approximately 10 millimeters and a lateral radius of approximately 7.9 millimeters. In the illustrated embodiment, the applicator head has a hollow cavity 660 for a portion of the length from the proximal mounting end 652. The cavity reduces the overall mass of the applicator head to reduce the energy required to reciprocate the applicator head as described below.

In the illustrated embodiment, percussive massage applicator 100 is assembled by positioning and securing the motor assembly 124 in the upper body portion 112 as described above. A cable (not shown) from the motor 310 in the motor assembly is connected to the five-pin second plug 172.

After installing the motor assembly 300, the reciprocation assembly 126 is installed in the enclosure 110 by first attaching the flexible interconnection linkage 512 to the crank engagement bearing holder 510 by threading the first threaded interconnect rod 580 into the longitudinal central bore 554. The first threaded interconnect rod is secured within the longitudinal central bore by engaging the bearing holder setscrew 566 into the threaded radial bore 564. The annular bearing 536 is installed within the cylindrical cavity 534 of the bearing bracket and is secured therein by positioning the lower end wall 538 over the bearing and securing the lower end wall with the screws 548. It should be understood that the annular bearing can be installed either before or after the bearing bracket is attached to the flexible linkage.

The crank engagement bearing holder 510 and the connected flexible interconnection linkage 512 are installed by positioning the central bore 542 of the annular bearing 536 over the cylindrical crank pivot 370 of the eccentric crank 360 with the flexible interconnection linkage aligned with the longitudinal axis 116. The second threaded interconnect rod 582 is directed toward the bore 424 of the cylinder body 422 within the cylindrical outer sleeve 400 at the distal end of the percussive massage applicator 100.

Figure 7:
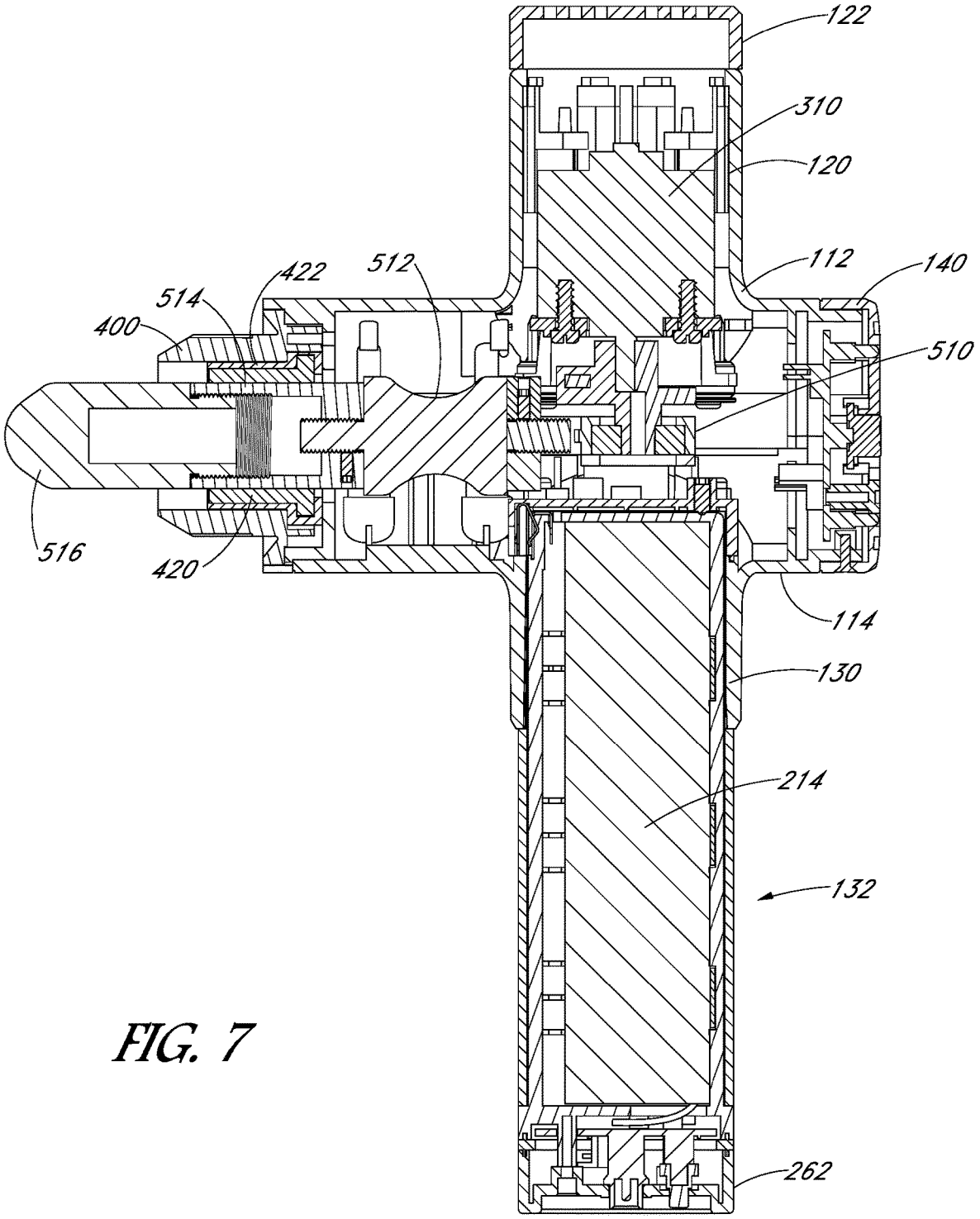
FIG. 7 illustrates an elevational cross-sectional view of the portable electromechanical percussive massage applicator of FIGS. 1 and 2 taken along the line 7-7 in FIG. 1, the view taken through the longitudinal centerline of the apparatus.

The applicator head 516 is attached to the piston 514 by threading the engagement portion 656 of the applicator head into the threaded first portion 608 of the piston. The interconnected applicator head and piston are then installed through the bore 424 of the cylinder body 422 to engage the second bore 610 of the piston with the second threaded interconnector rod 582 of the flexible interconnection linkage 512. The interconnected applicator had and the piston are rotated within the bore of the cylinder body to thread the second bore of the piston onto the second threaded interconnect rod. When the second bore and the second threaded interconnector rod are fully engaged as shown in FIG. 7, for example, the piston setscrew 622 is threaded into the third bore 620 of the piston to engage the threads of the second threaded interconnect rod of the flexible linkage to secure the piston to the flexible linkage. In the illustrated embodiment, the interconnected threads of the piston and the second threaded interconnect rod are configured such that the third bore of the piston is directed generally downward as shown in FIG. 7 and is thereby accessible to tighten the piston setscrew within the third bore. After the piston is secured to the flexible linkage, the applicator head may be unthreaded from the piston without unthreading the piston from the flexible linkage to allow the applicator head to be removed and replaced without having to remove the piston.

After installing the reciprocation assembly 126, as described above, the lower body portion 114 is installed by aligning the lower body portion with the upper body portion 112 and securing the two body portions together using the screws 184 (FIG. 5). The main body endcap 140 is then placed over the proximal ends of the two body portions to engage the protrusions 142 of the endcap with the L-shaped notches 146 of the two body portions. The endcap is then secured to prevent inadvertent removal by inserting the screw 148 through the bore 150 and into the material of the lower body portion.

The battery assembly 132 is installed in the battery assembly receiving enclosure 130 of the lower body portion 114 of the percussive massage applicator 100 and electrically and mechanically engaged as described above. The battery assembly may be charged while installed; or the battery assembly may be charged while removed from the percussive massage applicator.

The operation of the percussive massage applicator 100 is illustrated in FIGS. 16-19, which are views looking up at the motor assembly in the upper body portion 112 with the lower cover 114 and the battery assembly 132 removed. In FIG. 16, the eccentric crank 360 attached to the shaft 312 of the motor 310 is shown at a first reference position, which is designated as the 12 o'clock position. In this first reference position, the cylindrical crank pivot 370 on the outer surface 366 of the eccentric crank is at a most proximal location (nearest the top of the illustration in FIG. 16). The crank pivot is positioned in alignment with the longitudinal axis 116. The crank engagement bearing holder 510, the flexible interconnection linkage 512, the piston 514 and the applicator head 516 are all aligned with the longitudinal axis. In this first position, the distal end of the applicator head extends by a first distance D1 from the distal end of the outer sleeve 400.

In FIG. 17, the shaft 312 of the motor 300 has rotated the eccentric crank 360 clockwise 90 degrees (as viewed in FIGS. 16-19). Accordingly, the cylindrical crank pivot 370 on the eccentric crank is now positioned to the right of the shaft of the motor at a second position designated as the 3 o'clock position. The central bore 542 of the annular bearing 536 within the crank engagement bearing holder 510 must move to the right because of the engagement with the cylindrical crank pivot. The piston 514 is constrained by the bore 424 of the cylinder body 422 (FIGS. 12-13) to remain aligned with the longitudinal axis 116. The second end 572 of the flexible interconnection linkage 512 remains aligned with the piston because of the second threaded interconnect rod 582. The first end 570 of the flexible interconnection linkage remains aligned with the crank engagement bearing holder 510 because of the first threaded interconnect rod 580. The smaller middle portion 574 of the flexible interconnection linkage allows the flexible interconnection to bend to the right to allow the crank engagement bearing holder to tilt to the right as shown. In addition to moving to the right and away from the longitudinal axis, the cylindrical crank pivot has also moved distally away from the proximal end of the percussive massage applicator 100, which causes the crank engagement bearing holder to also move distally. The distal movement of the crank engagement bearing holder is coupled to the piston via the flexible interconnector to push the piston longitudinally within the cylinder. The longitudinal movement of the piston causes the applicator head 516 to extend further outward to a second distance D2 from the distal end of the outer sleeve 400. The second distance D2 is greater than the first distance D1.

In FIG. 18, the shaft 312 of the motor 310 has rotated the eccentric crank 360 clockwise an additional 90 degrees to a position designated as the 6 o'clock position. Accordingly, the cylindrical crank pivot 370 is again aligned with the longitudinal axis 116. The crank engagement bearing holder 510 and the flexible interconnection linkage 512 have returned to the initial straight-line configuration in alignment with the piston 514. The cylindrical crank pivot has moved further from the proximal end of the percussive massage applicator 100. Thus, the crank engagement bearing holder and the flexible interconnection linkage push the piston longitudinally within the bore 424 of the cylinder body 422 to cause the applicator head 516 to extend further outward to a third distance D3 from the distal end of the outer sleeve 400. The third distance D3 is greater than the second distance D2.

In FIG. 19, the shaft 312 of the motor 310 has rotated the eccentric crank 360 clockwise an additional 90 degrees. Accordingly, the cylindrical crank pivot 370 is now positioned to the left of the shaft of the motor at a fourth position designated as the 9 o'clock position. The piston 514 is constrained by the bore 424 of the cylinder body 422 to remain aligned with the longitudinal axis 116. The smaller middle portion 574 of the flexible interconnection linkage 512 allows the flexible interconnection linkage to bend to the left to allow the crank engagement bearing holder 510 to tilt to the left as shown. In addition to moving to the left and away from the longitudinal axis, the cylindrical crank pivot has also moved proximally toward the proximal end of the percussive massage applicator 100. The proximal movement pulls the piston longitudinally within the cylinder to cause the applicator head 516 to retreat proximally to a fourth distance D4 from the distal end of the outer sleeve 400. The fourth distance D4 is less than the third distance D2 and is substantially the same as the second distance D2.

A further rotation of the shaft 312 of the motor 310 by an additional 90 degrees clockwise returns the eccentric crank 360 to the original 12 o'clock position shown in FIG. 16 to return the cylindrical crank pivot 370 to the most proximal location. This further rotation causes the distal end of the applicator head 516 to retreat to the original first distance D1 from the outer sleeve 400. Continued rotation of the shaft of the motor causes the distal end of the applicator head to repeatedly extend and retreat with respect to the outer sleeve. By placing the distal end of the applicator head on a body part to be massaged, the applicator head applies percussive treatment to the selected body part.

In the illustrated embodiment, the axis of the cylindrical crank pivot 370 is located approximately 2.8 millimeters from the axis of the shaft 312 of the motor 310. Accordingly, the cylindrical crank pivot moves a total longitudinal distance of approximately 5.6 millimeters from the 12 o'clock position of FIG. 16 to the 6 o'clock position of FIG. 18. This results in a 5.6-millimeter stroke distance of the distal end of the applicator head 516 from the fully retreated first distance D1 to the fully extended third distance D3.

Conventional linkage systems between a crank and a piston have two sets of bearings. A first bearing (or set of bearings) couples a first end of a drive rod to a rotating crank. A second bearing (or set of bearings) couples a second end of a drive rod to a reciprocating piston. When the piston reaches each of the two extremes of the reciprocating motion, the piston must abruptly change directions. The stresses caused by the abrupt changes in direction are applied against the bearings at each end of the drive rod as well as to the other components in the linkage system. The abrupt changes of direction also tend to generate substantial noise.

The reciprocating linkage system 126 described herein eliminates a second bearing (or set of bearings) at the piston 514. The piston is linked to the other components of the linkage via the flexible interconnection linkage 512, which bends as the cylindrical crank pivot 370 rotates about the centerline of the shaft 312 of the motor 300. The flexible interconnect cushions the abrupt changes in direction at each end of the piston stroke. For example, as the applicator head 516 and the piston reverse direction from distal movement to proximal movement at the 6 o'clock position, the flexible interconnect may stretch by a small amount during the transition. The stretching of the flexible interconnect reduces the coupling of energy through the linkage system to the bearing 536 (FIG. 14) and the cylindrical crank pivot. Similarly, as the applicator head and the piston reverse direction from proximal movement to distal movement at the 12 o'clock position, the flexible interconnect may compress by a small amount during the transition. The compression of the flexible interconnect reduces the coupling of energy though the linkage system to the bearing and the cylindrical crank pivot. Thus, in addition to eliminating the bearing at the piston end of the linkage system, the flexible interconnect also reduces the stress on the bearing at the crank end of the linkage system.

The flexible interconnection linkage 512 in the linkage assembly 126 also reduces the noise of the operating percussive massage applicator 100. The effectively silent stretching and compressing of the flexible interconnect when the reciprocation reverses direction at the 6 o'clock and 12 o'clock positions, respectively, eliminates the conventional metal-to-metal interaction that would occur if the linkage system were coupled to the piston 514 with a conventional bearing.

As discussed above, the bullet-shaped applicator head 516 is removably threaded onto the piston 514. The bullet-shaped applicator head may be unscrewed from the piston and replaced with a spherical-shaped applicator head 700, shown in FIG. 20. A spherical-shaped distal end portion 702 of the applicator head extends from an applicator main body portion 704, which corresponds to the main body portion 654 of the bullet-shaped applicator head. The spherical-shaped applicator head includes an engagement portion (not shown) corresponding to the engagement portion 656 of the bullet-shaped applicator head. The spherical-shaped applicator head may be used to apply percussive massage to larger areas of the body to reduce the force on the treated area and to allow the angle of application to be varied.

The bullet-shaped applicator head 516 may also be unscrewed and replaced with a disk-shaped applicator head 720 shown in FIG. 21. A disk-shaped distal end portion 722 of the applicator head extends from an applicator main body portion 724, which corresponds to the main body portion 654 of the bullet-shaped applicator head. The disk-shaped applicator head includes an engagement portion (not shown) corresponding to the engagement portion 656 of the bullet-shaped applicator head. The disk-shaped applicator head may be used to apply percussive massage to a larger area of the body to reduce the force on the treated area.

The bullet-shaped applicator head 516 may also be unscrewed and replaced with a Y-shaped applicator head 740 shown in FIG. 22. A Y-shaped distal end portion 742 of the applicator head extends from an applicator main body portion 744, which corresponds to the main body portion 654 of the bullet-shaped applicator head. The Y-shaped applicator head includes an engagement portion (not shown) corresponding to the engagement portion 656 of the bullet-shaped applicator head. The Y-shaped applicator head includes an applicator base 750. A first finger 752 and a second finger 752 extend from the applicator base and are spaced apart as shown. The two fingers of the Y-shaped applicator head may be used to apply percussive massage to muscles on both sides of the spine without applying direct pressure to the spine.

The portable electromechanical percussive massage applicator 100 may be provided with power and controlled in a variety of manners. FIG. 23 illustrates an exemplary battery control circuit 800, which comprises in part the circuitry mounted on the battery controller PCB 252. In FIG. 23, previously identified elements are numbered with like numbers as before.

The battery control circuit 800 includes the power adapter input jack 254. In the illustrated embodiment, the input power provided to the jack as a DC input voltage of approximately 30 volts DC. Other voltages may be used in other embodiments. The input voltage is provided with respect to a circuit ground reference 810. The input voltage is applied across a voltage divider circuit comprising a first voltage divider resistor 820 and a second voltage divider resistor 822. The resistances of the two resistors are selected to provide a signal voltage of approximately 5 volts when the DC input voltage is present. The signal voltage is provided through a high resistance voltage divider output resistor 824 as a DCIN signal.

The DC input voltage is provided through a rectifier diode 830 and a series resistor 832 to a DC input bus 834. The rectifier diode prevents damage to the circuitry if the polarity of the DC input voltage is inadvertently reversed. The voltage on the DC input bus is filtered by an electrolytic capacitor 836.

The DC input voltage on the DC input bus 834 is provided through a 10-volt Zener diode 840 and a series resistor 842 to the voltage input of a voltage regulator 844. The input of the voltage regulator is filtered by a filter capacitor 846. In the illustrated embodiment, the voltage regulator is a HT7550-1 voltage regulator, which is commercially available from Holtek Semiconductor, Inc., of Taiwan. The voltage regulator provides an output voltage of approximately 5 volts on a VCC bus 848, which is filtered by a filter capacitor 850.

The voltage on the VCC bus is provided to a battery charger controller 860. The controller receives the DCIN signal from the voltage divider output resistor 824. The battery charger controller is responsive to the active high state of the DCIN signal to operate in the manner described below to control the charging of the battery unit 214. When the DCIN signal is low to indicate that the charging voltage is not present, the controller does not operate.

The battery charger controller 860 provides a pulse width modulation (PWM) output signal to the input of a buffer circuit 870, which comprises a PNP bipolar transistor 872 having a collector connected to the circuit ground reference 810. The PNP transistor has an emitter connected to the emitter of an NPN bipolar transistor 874. The bases of the two transistors are interconnected and form the input to the buffer circuit. The two transistor bases are connected to receive the PWM output signal from the controller. The commonly connected bases are also connected to the commonly connected emitters via a base-emitter resistor 876. The collector of the NPN connected to the VCC bus 848.

The commonly connected emitters of the PNP transistor 872 and the NPN transistor 874 are connected to an anode of a protection diode 878. A cathode of the protection diode is connected to the VCC bus 848. The protection diode prevents the voltage on the commonly connected emitters from exceeding the voltage on the VCC bus by more than one forward diode drop (e.g., approximately 0.7 volt). The commonly connected emitters of the two transistors are also connected through a resistor 880 to a first terminal of a coupling capacitor 882. A second terminal of the coupling capacitor is connected to a gate terminal of a power metal oxide semiconductor transistor (MOSFET) 884. In the illustrated embodiment, the MOSFET comprises an STP9527 P-Channel Enhancement Mode MOSFET, which is commercially available from Stanson Technology in Mountain View, Calif. The gate terminal of the MOSFET is also connected to an anode of a protection diode 886, which has a cathode connected a source (S) terminal of the MOSFET. The protection diode prevents the voltage on the gate terminal from exceeding the voltage on the source terminal by more than the forward diode voltage of the protection diode (e.g., approximately 0.7 volt). The gate terminal of the MOSFET is also connected to the source terminal of the MOSFET by a pull-up resistor 888. The source of the MOSFET is connected to the DC input bus 834.

A drain (D) of the MOSFET 884 is connected to an input node 892 of a buck converter 890. The buck converter further includes an inductor 894 connected between the input node and an output node 896. The output node (also identified as VBAT) is connected to a positive terminal of the battery unit 214. A negative terminal of the battery unit is connected to the circuit ground 810 via a low-resistance current sensing resistor 900. The input node is further connected to a cathode of a free-wheeling diode 902, which has an anode connected to the circuit ground. A first terminal of a resistor 904 is also connected to the input node. A second terminal of the resistor is connected to a first terminal of a capacitor 906. A second terminal of the capacitor is connected to the circuit ground. Accordingly, a complete circuit path is provided from the circuit ground, through the free-wheeling diode, through the inductor, through the battery unit, and through the current sensing resistor back to the circuit ground.

The battery charger controller 860 controls the operation of the buck converter 890 by applying an active low pulse on the PWM output connected to the buffer circuit 870, which responds by pulling down the voltage on the commonly connected emitters of the two transistors 872, 874 to a voltage near the ground reference potential. The low transition to the ground reference potential is coupled through the resistor 880 and the coupling capacitor 882 to the gate terminal of the MOSFET 884 to turn on the MOSFET and couple the DC voltage on the DC input bus 834 to the input node 892 of the buck converter 890. The DC voltage causes current to flow though the inductor 894 to the battery unit 214 to charge the battery unit. When the PWM signal from the battery charger controller is turned off (returned to an inactive high state), the MOSFET is turned off and no longer provides a DC voltage to the input node of the buck converter; however, the current flowing in the inductor continues to flow through the battery unit and back through the free-wheeling diode as the inductor discharges to continue charging the battery unit until the inductor is discharged. The width and repetition rate of the active low pulses generated by the battery charger controller determine the current applied to charge the battery unit in a known manner. In the illustrated embodiment, the PWM signal has a nominal repetition frequency of approximately 62.5 kHz.

The battery charger controller 860 controls the width and repetition rate of the pulses applied to the MOSFET 894 in response to feedback signals from the battery unit 214. A battery voltage sensing circuit 920 comprises a first voltage feedback resistor 922 and a second voltage feedback resistor 924. The two resistors are connected in series from the output node 896 to the circuit ground 810 and are thus connected across the battery unit. A common voltage sensing node 926 of the two resistors is connected to a voltage sensing (VSENSE) input of the controller. The battery charger controller monitors the voltage sensing input to determine the voltage across the battery unit to determine when the battery unit is at or near a maximum voltage of approximately 25.2 volts such that the charging rate should be reduced. In the illustrated embodiment, a filter capacitor 928 is connected from the voltage sensing node to the circuit ground to reduce noise on the voltage sensing node.

As described above, the negative terminal of the battery unit 214 is connected to the circuit ground 810 via the low-resistance current sensing resistor 900, which may have a resistance of, for example, 0.1 ohm. A voltage develops across the current sensing resistor proportional to the current flowing through the battery unit when charging. The voltage is provided as an input to a current sensing (ISENSE) input of the battery charger controller 860 via a high-resistance (e.g., 20,000-ohm) resistor 930. The current sensing input is filtered by a filter capacitor 932. The battery charger controller monitors the current flowing through the battery unit and thus through the current sensing resistor to determine when the current flow decreases as the charge on the battery unit nears a maximum charge. The battery charger controller may also respond to a large current through the battery unit and reduce the pulse width modulation to avoid exceeding a maximum magnitude for the charging current.

The output node 896 of the buck converter 890 is also the positive voltage node of the battery unit 214. The positive battery voltage node is connected to a first terminal 940 of the on-off switch 256. A second terminal 942 of the on-off switch is connected to a voltage output terminal 944, which is identified as VOUT. The voltage output terminal is connected to the first contact 206A of the battery assembly 132. The first contact of the battery assembly engages the first leaf spring contact 204A when the battery assembly is inserted into the battery receiving tray 200. When the switch is closed, the first terminal and the second terminal of the switch are electrically connected to couple the battery voltage to the voltage output terminal. The voltage output terminal is coupled to an output voltage sensing circuit 950, which comprises a first voltage divider resistor 952 and a second voltage divider resistor 954 connected in series between the voltage output terminal and the circuit ground. A common node 956 between the two resistors is connected to a VOUT sensing input of the battery charger controller 860. The common node is also connected to the circuit ground by a Zener diode 958, which clamps the voltage at the common node to no more than 4.7 volts. The resistances of the two resistors are selected such that when the switch is closed and the output voltage is applied to the output terminal, the voltage on the common node and the VOUT sensing input of the controller is approximately 4.7 volts to indicate that the switch is closed and that the battery voltage is being provided to the selected terminal of the battery assembly.

A second contact 206B of the battery assembly 132 is connected to a battery charge (CHRG) output signal of the battery charger controller 860 via a signal line 960. The battery charge output signal is an analog signal having a magnitude indicative of the charging state of the battery unit 214. The second battery assembly contact engages the second leaf spring contact 204B when the battery assembly is inserted into the battery receiving tray 200.

A third contact 206C of the battery assembly 132 is connected to the negative terminal of the battery unit 214 via a line 970 and is identified as the battery ground (GND) that is provided to the motor control PCB 160 as described below. Note that the battery ground is coupled to the circuit ground by the 0.1-ohm current sensing resistor 900. The current flowing out of the positive terminal of the battery unit to the motor control PCB and back to the negative terminal of the battery unit does not flow through the current sensing resistor. The third battery assembly contact engages the third leaf spring contact 204C when the battery assembly is inserted into the battery receiving tray 200.

The battery charger controller 860 drives the dual-color LEDs 260 on the battery controller PCB. The controller includes a first output (LEDR) that drives the red-emitting LEDs in the dual-color LEDs and includes a second output (LEDG) that drives the green-emitting LED in the dual-color LEDs. A first current limiting resistor 980 couples the first output to the anodes of the red-emitting LEDs in a first set of three dual-color LEDs. A second current limiting resistor 982 couples the second output to the anodes of the green-emitting LEDs in the first set of three dual-color LEDs. A third current limiting resistor 984 couples the first output to the anodes of the red-emitting LEDs in a second set of three dual-color LEDs. A fourth current limiting resistor 986 couples the second output to the anodes of the green-emitting LEDs in the second set of three dual-color LEDs.

In the illustrated embodiment, the dual-color LEDs 260 are driven with different duty cycles to indicate the present state of charge of the battery unit 214. For example, in a first state, the first output (LEDR) of the controller 860 is driven with a 100 percent duty cycle and the second output (LEDG) of the controller is not driven such that only the red-emitting LEDs are illuminated to indicate that the battery unit needs be charged. In a second state, the first output is driven with a 75 percent duty cycle and the second output is driven with a 25 percent duty cycle such that the resulting perceived color is a mixture of red and green. In a third state, the first output and the second output are both driven with a respective 50 percent duty cycle. In a fourth state, the first output is driven with a 25 percent duty cycle and the second output is driven with a 75 percent duty cycle. In a fifth state, the first output is not driven and the second output is driven with a 100 percent duty cycle such that the color is entirely green to indicate that the battery unit is at or near a fully charged state. The duty cycles at which the two outputs are driven may be interleaved such that the two outputs are not on at the same time. Other than at the first state, the duty cycles are repeated at a rate sufficiently high that the enabled LEDs appear to be on at all times without a perceptible flicker. When the battery controller is in the first state, the battery controller may blink the red-emitting LEDS on and off at a perceptible rate to remind the user that the charge on the battery is low and should be charged before continuing to use the percussive massage applicator 100. In certain embodiments, the first state may be further segmented into two charge ranges. In a first range of charges within the first state, the red LEDs are driven with a constant illumination to indicate that the charge on the charge on the battery unit is low and that the battery unit should be charged soon. In a second range of charges, the red LEDs are blinked to indicate that the charge in the battery unit is very low and that the battery unit should be charged promptly.

FIG. 24 illustrates an exemplary motor controller circuit 1000, which comprises in part the circuitry mounted on the motor controller PCB 160. In FIG. 24, previously identified elements are numbered with like numbers as before. As described above, the battery assembly 132 provides the positive battery output voltage VOUT on the first leaf spring contact 204A of the receiving tray 200 when the battery assembly is inserted into the receiving tray. The positive battery output voltage is identified as VBAT in FIG. 24. The CHRG signal from the battery assembly is provided to the second leaf spring contact 204B when the battery assembly is inserted into the receiving tray. The battery ground (GND) is provided to the third leaf spring contact 204C when the battery assembly is inserted into the receiving tray. The DC voltage, the battery ground and the CHRG signal are coupled via a three-wire cable 1010 to a cable jack 1012. The first plug 170 on the motor controller PCB plugs into the cable jack to receive the DC voltage on a first pin 1020, to receive the CHRG signal on a second pin 1022, and to receive the battery ground (GND) on a third pin 1024. The battery ground (GND) from the third pin of the first plug is electrically connected to a local circuit ground 1026.

The DC voltage (VBAT) on the first pin 1020 of the first plug 170 is filtered by a filter capacitor 1030 connected between the first pin of the first plug and the local circuit ground 1026. The DC voltage is also provided to a first terminal of a current limiting resistor 1032. A second terminal of the current limiting resistor is provided to the voltage input terminal of a voltage regulator 1040. The voltage regulator receives the battery voltage and converts the battery voltage to 5 volts. The 5-volt output of the voltage regulator is provided on a local VCC bus 1042. The local VCC bus is filtered by a filter capacitor 1044, which is connected between the local VCC bus and the local circuit ground. In the illustrated embodiment, the voltage regulator is a 78L05 three-terminal regulator, which is commercially available from a number of manufacturers, such as, for example, National Semiconductor Corporation of Santa Clara, Calif.

The CHRG signal on the second pin 1022 of the first plug 170 is provided to a charge (CHRG) input of a motor controller 1050 via a series resistor 1052. The charge input to the motor controller is filtered by a filter capacitor 1054. The motor controller receives the 5-volt supply voltage from the VCC bus 1042

The DC voltage from the first pin 1020 of the first plug is also provided directly to a first pin 1060 of the five-pin second plug 172. The second plug 172 is connectable to a second jack 1070 having a corresponding number of contacts. The second jack is connected via a five-wire cable 1072 to the motor 310.

A second pin 1080 of the second plug is a tachometer (TACH) pin, which receives a tachometer signal from the motor 310 indicative of the present angular velocity of the motor. For example, the tachometer signal may comprise one pulse for every revolution of the shaft 312 of the motor or one pulse per partial revolution. The tachometer signal is provided to a first terminal of a first resistor 1084 in a voltage divider circuit 1082. A second terminal of the first resistor is connected to a first terminal of a second resistor 1086 in the voltage divider circuit. A second terminal of the second resistor is connected to the local circuit ground. A common node 1088 between the first and second resistors in the voltage divider circuit is connected to the base of an NPN bipolar transistor 1090. An emitter of the NPN transistor is connected to ground. A collector of the NPN transistor is connected to the VCC bus 1042 via a pull-up resistor 1092. The NPN transistor inverts and buffers the tachometer signal from the motor and provides the buffered signal to a TACH input of the motor controller. The buffered signal varies between +5 volts (VCC) and the local circuit ground potential when the tachometer signal varies between the local circuit ground potential and the DC voltage potential from the battery.

A third pin 1100 of the second plug 172 is a clockwise/counterclockwise (CW/CCW) signal generated by the motor controller 1050 and coupled to the third pin via a current limiting resistor 1102. The state of the CW/CCW signal determines the rotational direction of the motor 310. In the illustrated embodiment, the CW/CCW signal is maintained at a state to cause clockwise rotation; however, the rotation can be changed to the opposite direction in other embodiments.

A fourth pin 1110 of the second plug 172 is connected to the local circuit ground 1026, which corresponds to the battery ground connected to the negative terminal of the battery unit 214 in FIG. 23.

A fifth pin 1120 of the second plug 172 receives a pulse width modulation (PWM) signal generated by the motor controller 1050. The PWM signal is coupled to the fifth pin via a current limiting resistor 1122. The motor 310 is responsive to the duty cycle and the frequency of the PWM signal to rotate at a selected angular velocity. As described below, the motor controller controls the PWM signal to maintain the angular velocity at one of three selected rotational speeds.

The motor controller 1050 has a switch-in (SWIN) input that receives an input signal from the pushbutton switch 162.

The pushbutton switch has a first contact connect to the local circuit ground 1026 and has a second contact connected to the VCC bus 1042 via a pull-up resistor 1130. The second contact is also connected to the local circuit ground via a filter capacitor 1132. The second is also connected to the SWIN input of the motor controller. The input signal is held high by the pull-up resistor until the switch contacts are closed by actuating the pushbutton switch. When the switch is actuated to close the contacts, the input signal is pulled to 0 volts (e.g., the potential on the local circuit ground). The filter capacitor reduces the switch contact bounce noise. The motor controller may include internal debounce circuitry to eliminate the effects of the switch contact bounce. The motor controller is initialized in an off state wherein no PWM signal is provided to the motor 310, and the motor does not rotate. The motor controller is responsive to a first activation of the switch to advance from the off-state to a first on-state wherein the PWM signal provided to the motor is selected to cause the motor to rotate at a first (low) speed. A subsequent activation of the switch advances the motor controller to a second on-state wherein the PWM signal provided to the motor is selected to cause the motor to rotate at a second (medium) speed. A subsequent activation of the switch advances the motor controller to a third on-state wherein the PWM signal provided to the motor is selected to cause the motor to rotate at a third (high) speed. A subsequent activation of the switch returns the motor controller to the initial off-state wherein no PWM signal is provided to the motor and the motor does not rotate. In the illustrated embodiment, the three rotational speeds of the motor are 2,000 rpm (low), 2,600 rpm (medium) and 3,000 rpm (high).

The motor controller 1050 generates a nominal PWM signal associated with the currently selected on-state (e.g., low, medium or high speed). Each on-state corresponds to a selected rotational speed as described above. The motor controller monitors the tachometer signal (TACH) received from the pin 1080 of the five-pin plug 172 via the voltage divider 1082 and the NPN transistor 1090. If the received tachometer signal indicates that the motor speed is below the selected speed, the motor controller adjusts the PWM signal (e.g. increases the pulse width or increases the repetition rate or both) to increase the motor speed. If the received tachometer signal indicates that the motor speed is above the selected speed, the motor controller adjusts the PWM signal (e.g. decreases the pulse width or decreases the repetition rate or both) to decrease the motor speed.

The motor controller 1050 generates a first set of three LED control signals (LEDS1, LEDS2, LEDS3). The first signal (LEDS1) in the first set is coupled via a current limiting resistor 1150 to the first speed indication LED 166A. The first signal in the first set is activated to illuminate the first speed indication LED when the motor controller is in the first on-state to drive the motor at the first (low) speed. The second signal (LEDS2) in the first set is coupled via a current limiting resistor 1152 to the second speed indication LED 166B. The second signal in the first set is activated to illuminate the second speed indication LED when the motor controller is in the second on-state to drive the motor at the second (medium) speed. The third signal (LEDS3) in the first set is coupled via a current limiting resistor 1154 to the third speed indication LED 166C. The third signal in the first set is activated to illuminate the third speed indication LED when the motor controller is in the third on-state to drive the motor at the third (high) speed.

The motor controller 1050 is further responsive to the CHRG signal from the input plug 170. As discussed above, the CHRG signal is generated by the battery charger controller 860 to indicate the state of charge of the battery unit 214. The motor controller determines the present state of charge of the battery unit from the CHRG input signal and displays the state of charge on the five battery charge state LEDs 168A, 168B, 168C, 168D, 168E which are visible through the main body endcap 140. The motor controller generates a second set of five LED control signals (LEDC1, LEDC2, LEDC3, LEDC4, LEDC5). The first signal (LEDC1) in the second set is coupled via a current limiting resistor 1170 to the first charge LED 168A. The first signal in the second set is activated to illuminate the first charge indication LED when the battery unit has a lowest range of charge. The motor controller may blink the first charge indication LED at a perceptible rate to indicate the lowest range of charge. The color (e.g., red) of the light emitted by the first charge LED may differ from the color (e.g., green) of the light emitted by the other LEDS to further indicate the lowest range of charge (e.g., no more than 20 percent of charge remaining). The second signal (LEDC2) in the second set is coupled via a current limiting resistor 1172 to the second charge indication LED 168B. The second signal in the second set is activated to illuminate the second charge indication LED when the battery unit has a second range of charge (e.g., 21-40 percent of charge remaining). The third signal (LEDC3) in the second set is coupled via a current limiting resistor 1174 to the third charge indication LED 168C. The third signal in the second set is activated to illuminate the third charge indication LED when the battery unit has a third range of charge (e.g., 41-60 percent of charge remaining). The fourth signal (LEDC4) in the second set is coupled via a current limiting resistor 1176 to the fourth charge indication LED 168D. The fourth signal in the second set is activated to illuminate the fourth charge indication LED when the battery unit has a fourth range of charge (e.g., 61-80 percent of charge remaining). The fifth signal (LEDC5) in the second set is coupled via a current limiting resistor 1178 to the fifth charge indication LED 168B. The fifth signal in the second set is activated to illuminate the fifth charge indication LED when the battery unit has a fifth range of charge (e.g., 81-100 percent of charge remaining). It should be understood that the ranges of charge are only approximations and are provided as examples.

The portable electromechanical percussive massage applicator 100 described herein advantageously allows a massage therapist to effectively apply percussion massage over an extended time duration without excessive tiring and without being tethered to an electrical power cord. The reduced noise level of the portable electromechanical percussive massage applicator described herein allows the device to be used in quiet environment such that the person being treated with the device is able to relax and enjoy any ambient music or other soothing sounds provided in the treatment room.

As various changes could be made in the above constructions without departing from the scope of the invention, it is intended that all the matter contained in the above description or shown in the accompanying drawings shall be interpreted as illustrative and not in a limiting sense.

What is claimed is:

1. A battery-powered percussive massage device comprising:

a main enclosure extending along an axis, the main enclosure having a proximal end and a distal end, the main enclosure including a cavity;

a motor having a rotatable shaft;

a reciprocation assembly coupled to the rotatable shaft, the reciprocation assembly including a piston, the reciprocation assembly configured to reciprocate the piston along a reciprocation axis in response to rotation of the rotatable shaft, the reciprocation assembly positioned within the cavity of the main enclosure;

an applicator head having a proximal end removably attachable to the piston, and having a distal end that extends from the distal end of the main enclosure when the proximal end of the applicator is attached to the piston;

a handle attached to the main enclosure, the handle comprising:

a cavity, the cavity housing at least one battery and a printed circuit board, the printed circuit board including a battery controller that receives electrical power via a connector and that selectively charges the at least one battery, the printed circuit board having a mounting surface with a peripheral edge;

an outer gripping surface covering at least a portion of the handle;

a charge indication display, the charge indication display comprising a plurality of light-emitting diodes (LEDs) positioned on the mounting surface of the printed circuit board near the peripheral edge of the mounting surface, the LEDs generating light responsive to a charge condition of the at least one battery, the light emitted outward from the LEDs toward the peripheral edge of the printed circuit board; and an annular light transmissive ring positioned around the handle in alignment with the LEDs to propagate light from the LEDs to the outside of the handle.

2. The battery-powered percussive massage device of claim 1, wherein the light transmissive ring is circular.

3. The battery-powered percussive massage device of claim 1, wherein the light transmissive ring is translucent.

4. The battery-powered percussive massage device of claim 1, wherein the LEDs are multi-colored LEDs.

5. The battery-powered percussive massage device of claim 4, wherein the multi-colored LEDs are dual-color LEDs, each LED having a green input terminal to receive a green intensity control signal and a red input terminal to receive a red intensity control signal, and wherein the green intensity control signal and the red intensity control signal are selectively controlled to provide at least four color combinations.

6. The battery-powered percussive massage device of claim 1, wherein the outer gripping surface of the handle is cylindrical.

7. A battery-powered percussive massage device comprising:

a main enclosure extending along an axis, the main enclosure having a proximal end and a distal end, the main enclosure including a cavity;

a motor having a rotatable shaft;

a reciprocation assembly coupled to the rotatable shaft, the reciprocation assembly including a piston, the reciprocation assembly configured to reciprocate the piston along a reciprocation axis in response to rotation of the rotatable shaft, the reciprocation assembly positioned within the cavity of the main enclosure;

an applicator head having a proximal end removably attachable to the piston, and having a distal end that extends from the distal end of the main enclosure when the proximal end of the applicator is attached to the piston;

a handle having an outer gripping surface;

a battery unit housed at least partially within the handle;

a printed circuit board positioned within the handle, the printed circuit board including a battery controller that receives electrical power via a connector and that selectively charges the at least one battery, the printed circuit board having a mounting surface with a peripheral edge a charge indication display, the charge indication display comprising a plurality of light-emitting diodes (LEDs) positioned on the mounting surface of the printed circuit board near the peripheral edge of the mounting surface, the LEDs generating light responsive to a charge condition of the at least one battery unit, the light emitted outward from the LEDs toward the peripheral edge of the printed circuit board; and an annular light transmissive ring positioned around the handle in alignment with the LEDs to propagate light from the LEDs to the outside of the handle.

8. The battery-powered percussive massage device of claim 7, wherein the light transmissive ring is circular.

9. The battery-powered percussive massage device of claim 7, wherein the light transmissive ring is translucent.

10. The battery-powered percussive massage device of claim 7, wherein the LEDs are multi-colored LEDs.

11. The battery-powered percussive massage device of claim 10, wherein the multi-colored LEDs are dual-color LEDs, each LED having a green input terminal to receive a green intensity control signal and a red input terminal to receive a red intensity control signal, and wherein the green intensity control signal and the red intensity control signal are selectively controlled to provide at least four color combinations.

12. The battery-powered percussive massage device of claim 7, wherein the outer gripping surface of the handle is cylindrical.

13. A battery assembly for a battery-powered percussive massage device comprising:

an outer cover forming a cavity, the outer cover having a first end and a second end, the first end supporting a plurality of electrical contacts;

at least one battery unit housed within the cavity;

an outer gripping surface positioned over the outer cover;

a printed circuit board secured to the outer cover, the printed circuit board including a battery controller, the battery controller receiving electrical power via a connector and selectively charging the at least one battery, the printed circuit board having a mounting surface with a peripheral edge;

a charge indication display, the charge indication display comprising a plurality of light-emitting diodes (LEDs) positioned on the mounting surface of the printed circuit board near the peripheral edge of the mounting surface, the LEDs generating light responsive to a charge condition of the at least one battery unit, the light emitted outward from the LEDs toward the peripheral edge of the printed circuit board; and an annular light transmissive ring positioned around the peripheral edge of the printed circuit board in alignment with the LEDs to propagate light from the LEDs.

14. The battery assembly of claim 13, wherein the light transmissive ring is circular.

15. The battery assembly of claim 13, wherein the light transmissive ring is translucent.

16. The battery assembly of claim 13, wherein the LEDs are multi-colored LEDs.

17. The battery assembly of claim 16, wherein the multi-colored LEDs are dual-color LEDs, each LED having a green input terminal to receive a green intensity control signal and a red input terminal to receive a red intensity control signal, and wherein the green intensity control signal and the red intensity control signal are selectively controlled to provide at least four color combinations.

18. The battery assembly of claim 13, wherein the outer cover is cylindrical.

* * * * *